US011872457B2

(12) United States Patent
Hall et al.

(10) Patent No.: US 11,872,457 B2
(45) **Date of Patent: *Jan. 16, 2024**

(54) MOLDED HOCKEY PUCK WITH ELECTRONIC SIGNAL TRANSMITTER CORE

(71) Applicant: SportsMEDIA Technology Corporation, Durham, NC (US)

(72) Inventors: Gerard J. Hall, Durham, NC (US); Kirk Brown, Hume, VA (US); Kent Mason, San Jose, CA (US); Richard H. Cavallaro, Mountain View, CA (US); Jim Doeden, Pleasanton, CA (US)

(73) Assignee: SPORTSMEDIA TECHNOLOGY CORPORATION, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/554,882

(22) Filed: Dec. 17, 2021

(65) Prior Publication Data

US 2022/0105404 A1 Apr. 7, 2022

Related U.S. Application Data

(63) Continuation of application No. 16/879,366, filed on May 20, 2020, now Pat. No. 11,202,949, which is a (Continued)

(51) Int. Cl.
*A63B 67/14* (2006.01)
*A63B 43/00* (2006.01)
(Continued)

(52) U.S. Cl.
CPC ..... *A63B 67/14* (2013.01); *A63B 24/0021* (2013.01); *A63B 43/00* (2013.01); (Continued)

(58) Field of Classification Search
CPC ... A63B 43/06; A63B 43/004; A63B 24/0021; A63B 2102/22; A63B 2102/24; (Continued)

(56) References Cited

U.S. PATENT DOCUMENTS 2,020,484 A * 11/1935 Turner ..... A63B 43/06 473/570
2,425,966 A 8/1947 Tjomsland
(Continued)

FOREIGN PATENT DOCUMENTS

EP 819452 B1 11/2003

*Primary Examiner* — Melba Bumgarner
*Assistant Examiner* — Amir A Klayman
(74) *Attorney, Agent, or Firm* — NEO IP

(57) ABSTRACT

A hockey puck is disclosed including an internal signal transmitter enabling instantaneous identification of its position as it moves around. The puck includes two molded subcomponents, which encapsulate the signal transmitter. The signal transmitter includes driver electronics and a number of signal transmitters which together generate and emit an electromagnetic signal. The electromagnetic signal is emitted by a plurality of diodes mounted in light pipes enclosed within cavities in the subcomponents that extend to outer surfaces of the hockey puck components. The puck includes two subcomponents that are attached via complimentary sets of concentrically arranged wedges.

11 Claims, 36 Drawing Sheets

Related U.S. Application Data continuation-in-part of application No. 16/503,061, filed on Jul. 3, 2019, now Pat. No. 11,344,778, which is a continuation of application No. 16/027,594, filed on Jul. 5, 2018, now Pat. No. 10,343,042, which is a continuation of application No. 15/260,122, filed on Sep. 8, 2016, now Pat. No. 10,016,669.

(51) Int. Cl.
*A63B 71/06* (2006.01)
*A63B 24/00* (2006.01)
*A63B 102/24* (2015.01)

(52) U.S. Cl.
CPC ..... *A63B 71/06* (2013.01); *A63B 43/008* (2013.01); *A63B 2102/24* (2015.10)

(58) Field of Classification Search
CPC ... A63B 67/14; A63B 69/0026; A63B 43/008; A63B 43/00; A63B 71/06
See application file for complete search history.

(56) References Cited

U.S. PATENT DOCUMENTS 2,640,699 A 6/1953 Garbo
3,679,212 A 7/1972 Smith
3,704,891 A 12/1972 Chiarelli
4,078,801 A 3/1978 White
4,153,253 A 5/1979 White
4,183,536 A 1/1980 Platt
4,846,475 A 7/1989 Newcomb et al.
4,878,668 A 11/1989 Nevoral
4,963,117 A * 10/1990 Gualdoni ..... A63B 43/06 473/610
4,968,036 A 11/1990 Mark
4,991,847 A 2/1991 Rudell et al.
5,014,990 A 5/1991 Kaser et al.
5,054,778 A * 10/1991 Maleyko ..... H05B 45/00 446/485
5,207,720 A 5/1993 Shepherd
5,348,298 A 9/1994 Montgomery
5,366,219 A 11/1994 Salcer et al.
5,388,825 A 2/1995 Myers et al.
5,408,264 A 4/1995 Kurata et al.
5,429,359 A 7/1995 Timperman et al.
5,518,237 A 5/1996 Bellehumeur
5,526,326 A 6/1996 Fekete et al.
5,564,698 A * 10/1996 Honey ..... G01S 3/7864 473/588
5,564,702 A 10/1996 Meffert
5,615,880 A 4/1997 Booth et al.
5,649,758 A * 7/1997 Dion ..... A43B 1/0072 362/198
5,718,648 A 2/1998 La Savio
5,743,815 A 4/1998 Helderman
5,792,012 A 8/1998 Dudley
5,910,057 A 6/1999 Quimby et al.
5,912,700 A 6/1999 Honey et al.
5,946,643 A 8/1999 Zakutin
5,976,042 A 11/1999 LaMarche et al.
6,042,487 A 3/2000 Schrimmer et al.
6,089,998 A 7/2000 O'Neal et al.
6,113,504 A 9/2000 Kuesters
6,117,030 A 9/2000 Green
6,126,561 A 10/2000 Mark
6,252,632 B1 6/2001 Cavallaro
6,428,432 B1 8/2002 Kachel
6,450,661 B1 9/2002 Okumura
6,575,855 B1 * 6/2003 Buzak ..... A63B 43/06 273/DIG. 8
6,626,554 B2 * 9/2003 Rincover ..... F21V 15/012 362/186
6,666,782 B1 * 12/2003 Wu ..... A63H 33/22 446/485
6,726,580 B2 4/2004 Peterson
6,733,149 B1 * 5/2004 Chuang ..... A63B 43/06 446/175
6,770,012 B2 * 8/2004 Kuo ..... A63B 21/222 446/248
6,799,862 B2 10/2004 Galli
6,959,998 B2 * 11/2005 Tsukamoto ..... B62J 6/20 362/108
7,088,222 B1 8/2006 Dueker et al.
7,163,313 B2 1/2007 Rosenberg
7,261,432 B1 * 8/2007 Habitz ..... A63H 33/22 441/13
7,785,215 B2 8/2010 Kohnen
7,811,163 B2 10/2010 Ratcliffe
7,849,740 B2 12/2010 Nichol
8,622,857 B2 1/2014 Lo
8,727,918 B1 5/2014 Gentile
8,727,919 B1 5/2014 Gentile
9,022,620 B2 * 5/2015 Brinzey ..... F41H 13/0087 362/253
9,046,229 B2 * 6/2015 Bennett ..... F21L 4/08
9,227,112 B2 1/2016 Kodama et al.
9,279,557 B2 * 3/2016 Su ..... F21V 3/02
9,320,981 B2 4/2016 Dawson
9,463,360 B1 10/2016 Richard
9,557,038 B2 1/2017 Blair et al.
9,596,829 B2 3/2017 Wolfe, Jr. et al.
9,597,565 B2 * 3/2017 Forutanpour ..... A63B 71/06
9,597,569 B2 3/2017 Pederson
9,674,435 B1 6/2017 Monari et al.
9,757,633 B2 * 9/2017 Bauman ..... A63B 67/14
9,791,246 B2 10/2017 D'Andrade
9,873,064 B1 1/2018 Adkins et al.
10,029,155 B1 7/2018 Lo
D827,219 S 8/2018 Yan et al.
10,507,374 B2 12/2019 Kounellas
10,537,778 B2 1/2020 Mayer et al.
10,675,526 B2 6/2020 Moyerman et al.
10,722,773 B2 7/2020 Houlihan
10,874,902 B1 12/2020 Near
11,161,027 B2 11/2021 Kounellas et al.
11,202,949 B2 * 12/2021 Hall ..... A63B 24/0021
11,344,778 B2 * 5/2022 Mason ..... A63B 71/06
11,395,953 B2 7/2022 Kounellas et al.
2002/0137582 A1 9/2002 Yu
2004/0022070 A1 2/2004 Moore
2004/0138595 A1 7/2004 Fang
2005/0085316 A1 4/2005 Barr
2005/0261083 A1 * 11/2005 Liao ..... A63B 24/0021 473/570
2007/0247439 A1 10/2007 Daniel et al.
2007/0275801 A1 * 11/2007 Proulx ..... A63B 67/14 473/588
2007/0289553 A1 * 12/2007 Jager ..... A01K 15/026 119/710
2008/0039246 A1 * 2/2008 Martino ..... A63B 43/00 473/569
2011/0214616 A1 9/2011 Levin et al.
2011/0244981 A1 10/2011 Schrimmer et al.
2012/0169589 A1 7/2012 Albano et al.
2012/0287611 A1 11/2012 Wilson et al.
2013/0025543 A1 1/2013 Ottosson
2013/0167290 A1 7/2013 Ezra
2013/0210562 A1 8/2013 Zawitz
2013/0337948 A1 12/2013 Smith
2014/0127967 A1 5/2014 Liao
2014/0194232 A1 7/2014 Krysiak et al.
2014/0194258 A1 7/2014 Shorter
2014/0309059 A1 10/2014 Minch
2016/0273738 A1 9/2016 Wolfinbarger
2017/0246513 A1 8/2017 Fang
2018/0065012 A1 3/2018 Mason et al.
2018/0104563 A1 4/2018 Kounellas
2018/0326276 A1 11/2018 Mason et al.
2019/0036360 A1 1/2019 Zilles et al.
2019/0271572 A1 9/2019 Yang et al.
2020/0276487 A1 9/2020 Hall et al.
2020/0324185 A1 10/2020 Hulkki

(56) References Cited

U.S. PATENT DOCUMENTS

| | | | |
|---|---|---|---|
| 2020/0398111 | A1 | 12/2020 | Near |
| 2021/0077862 | A1 | 3/2021 | Hutt |
| 2022/0370875 | A1 | 11/2022 | Hurwitz |

* cited by examiner

Fig. 13
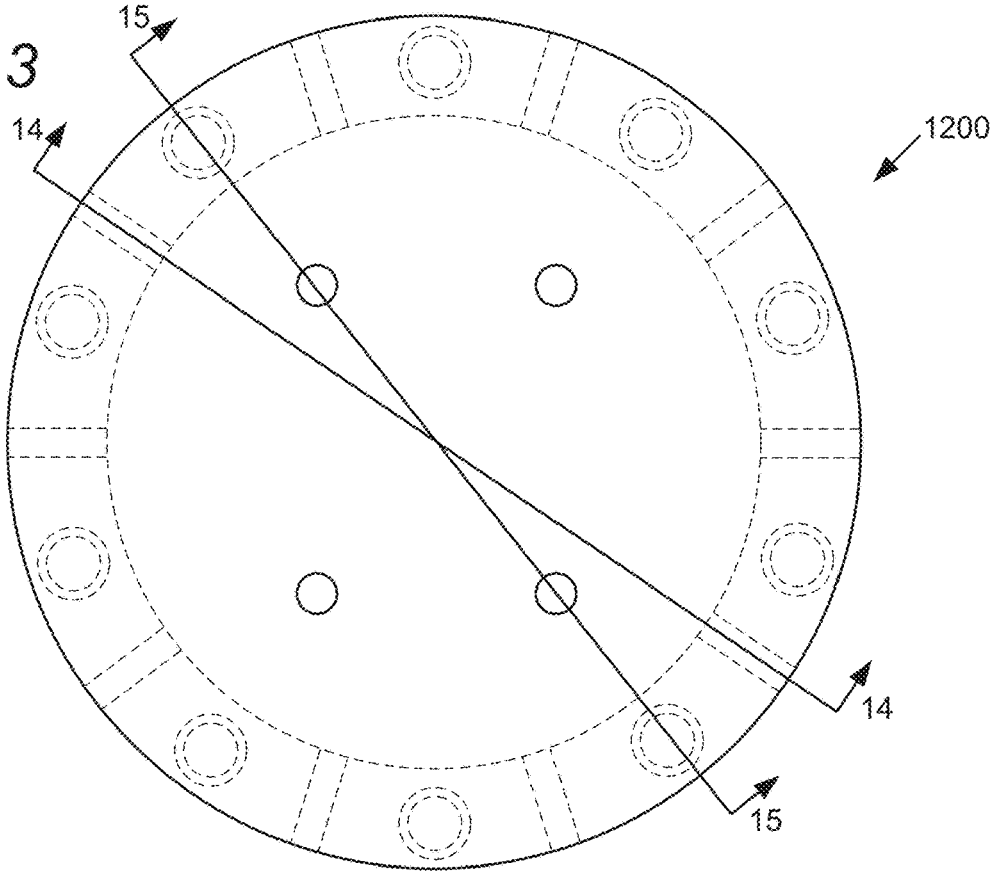
Fig. 14 (Line 14-14)
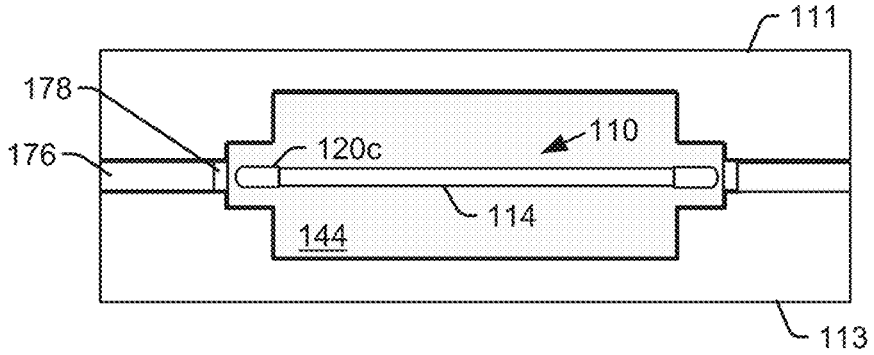
Fig. 15 (Line 15-15)
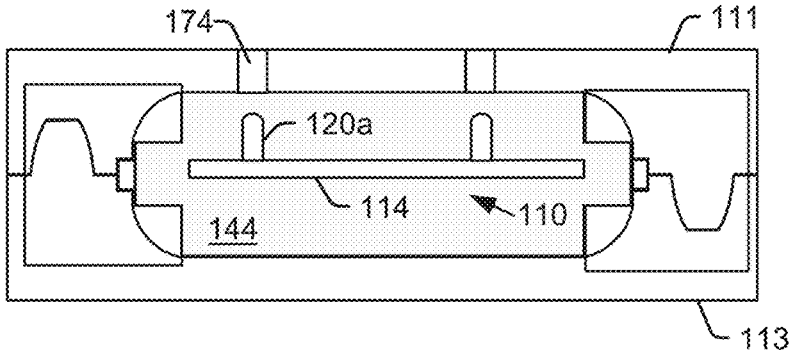

Fig. 16
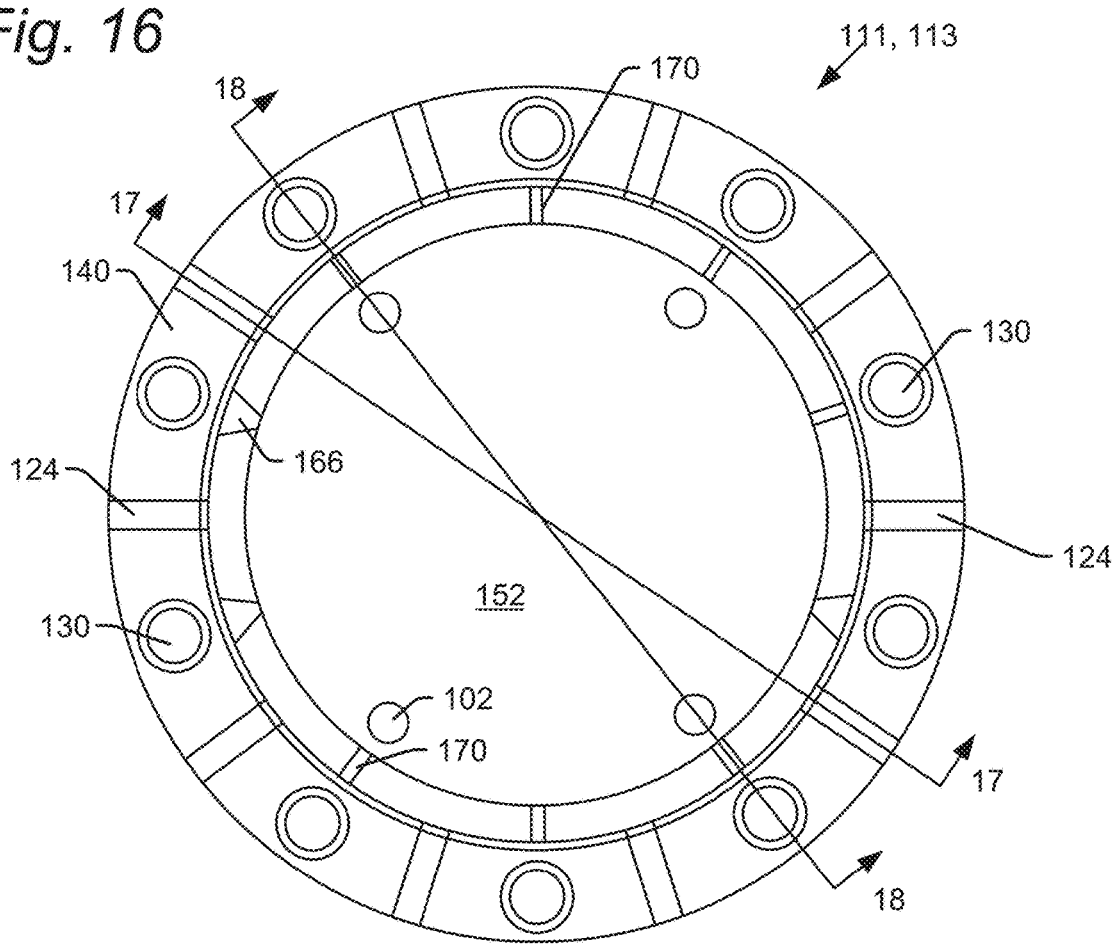
Fig. 17 (Line 17-17)
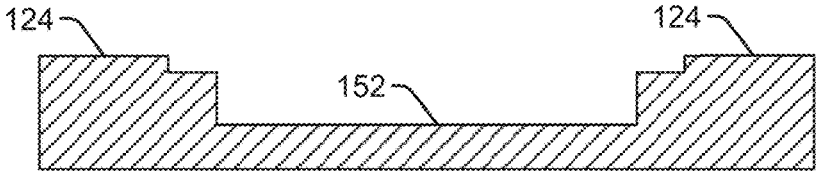
Fig. 18 (Line 18-18)
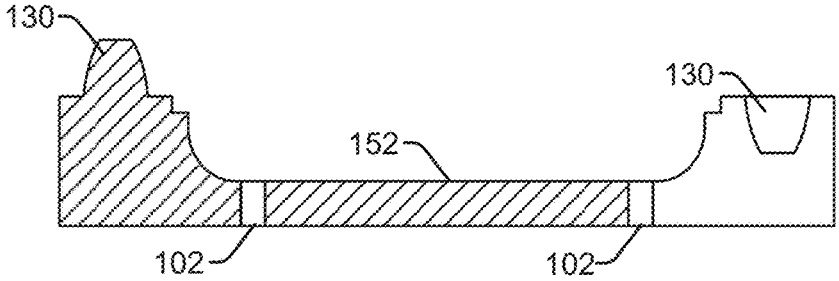

*Fig. 22*
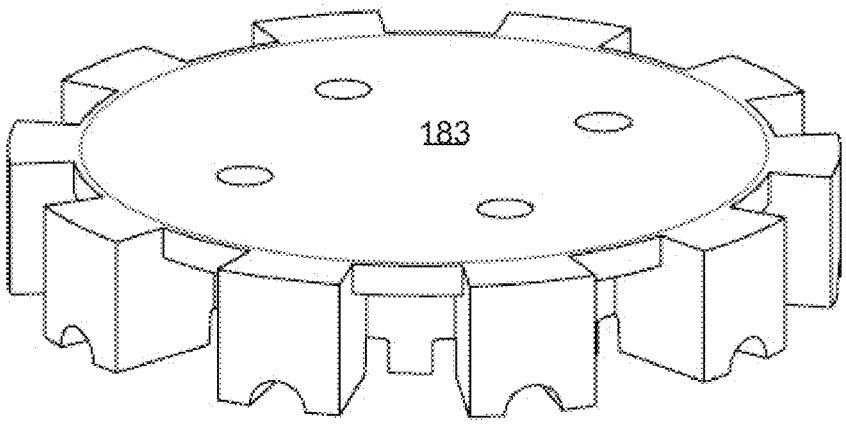
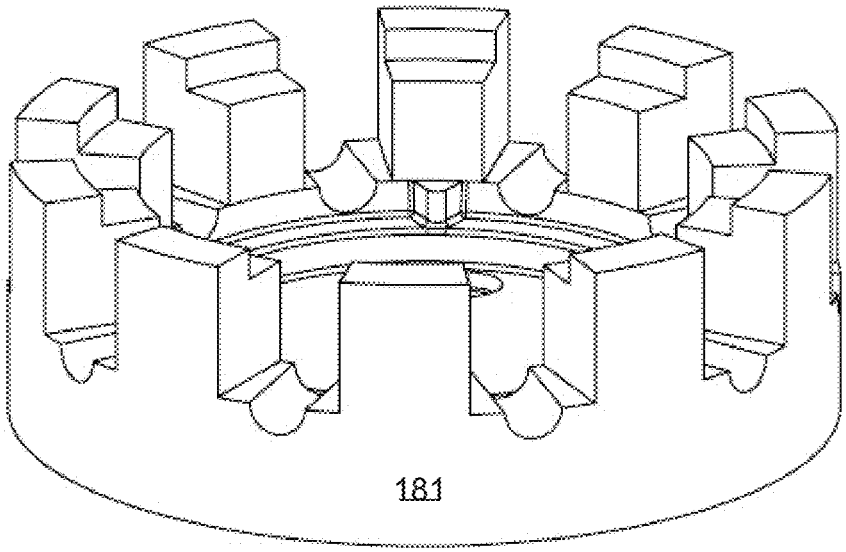

*Fig. 25*
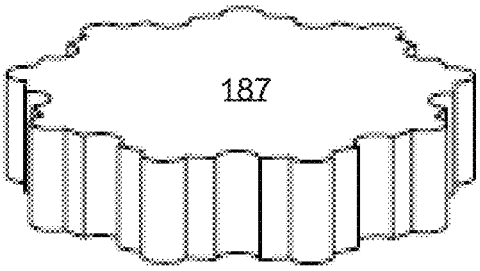
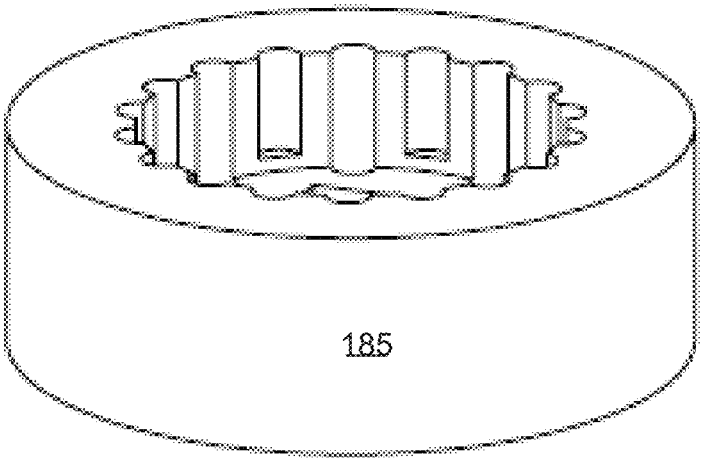

Fig. 28
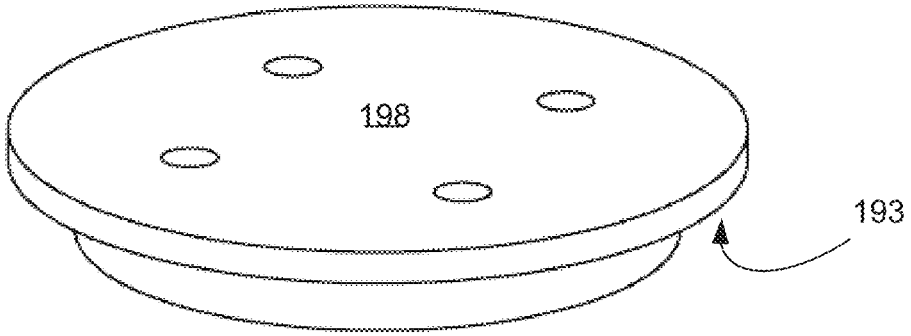
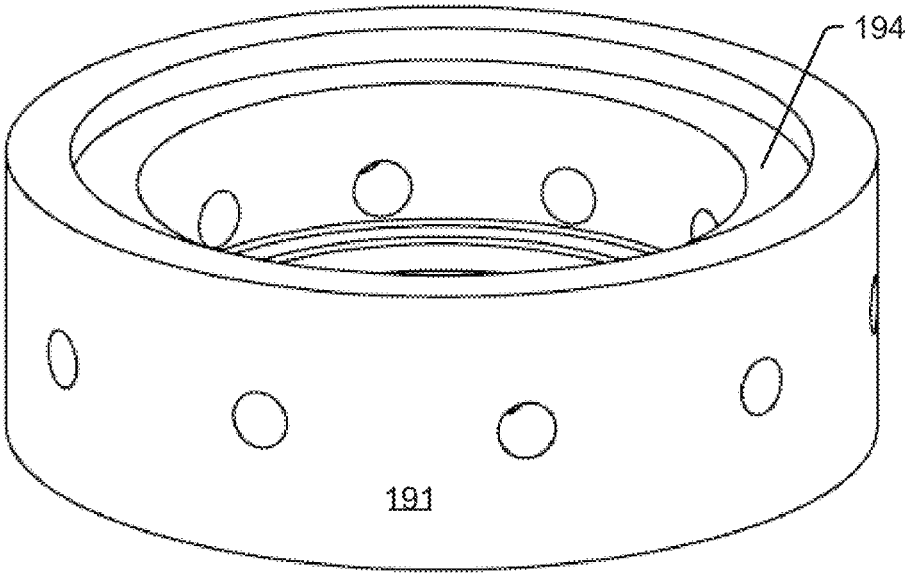

*Fig. 37*
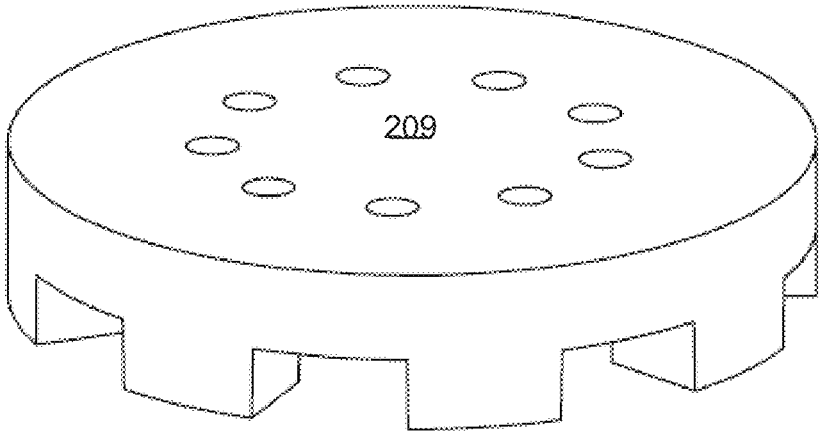
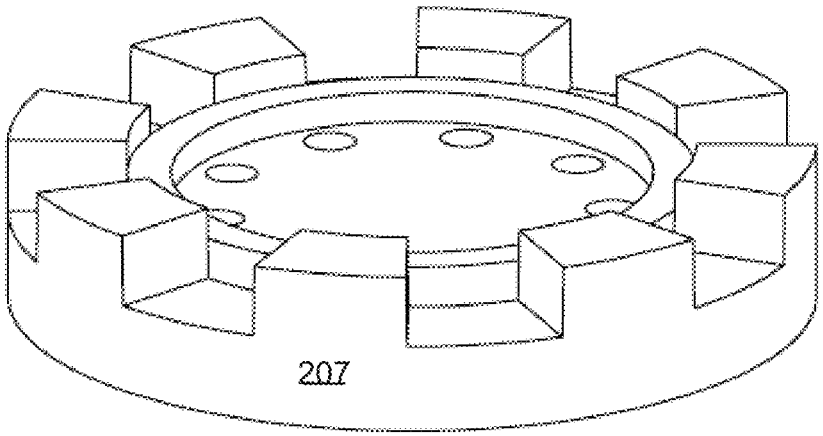

(Area C)

FIG. 45A
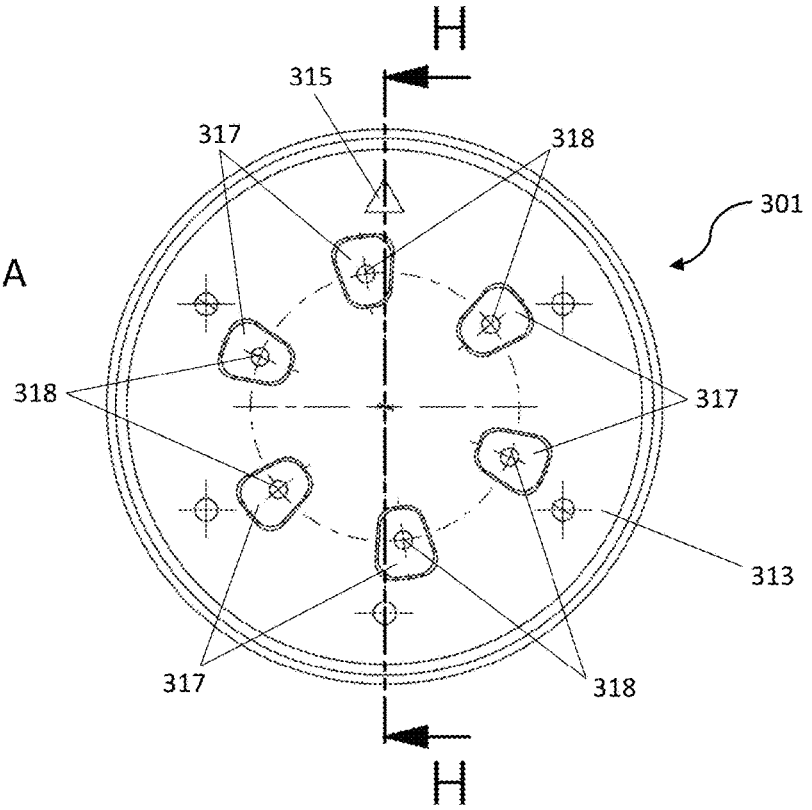
FIG. 45B
(Line H-H of
FIG. 45A)
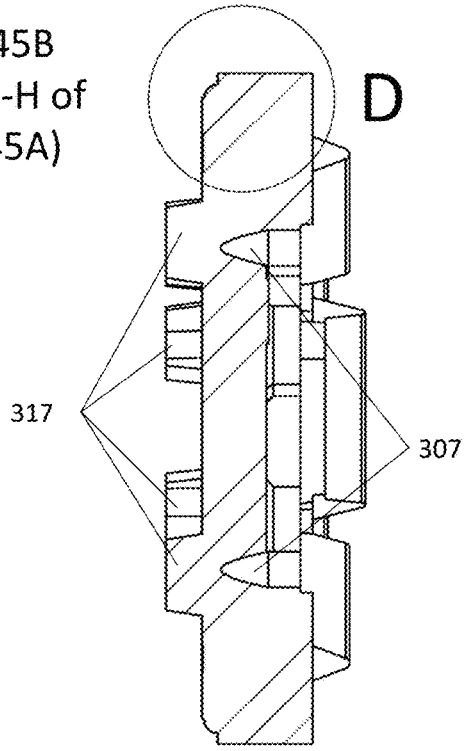
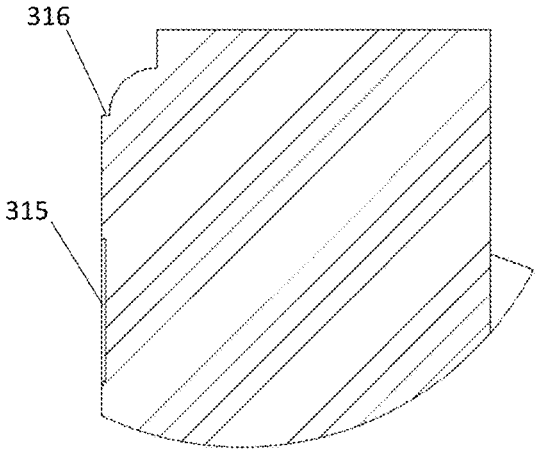
FIG. 45C
(Area D of FIG. 45B)

(Line F-F of FIG. 47A)

MOLDED HOCKEY PUCK WITH ELECTRONIC SIGNAL TRANSMITTER CORE

CROSS REFERENCE TO RELATED APPLICATIONS

This application is related to and claims priority from the following U.S. patents and patent applications. This application is a continuation of U.S. application Ser. No. 16/879,366, filed May 20, 2020, which is a continuation-in-part of U.S. application Ser. No. 16/503,061, filed Jul. 3, 2019, which is a continuation of U.S. application Ser. No. 16/027,594, filed Jul. 5, 2018, which is a continuation of U.S. application Ser. No. 15/260,122, now U.S. Pat. No. 10,016,669, filed Sep. 8, 2016, each of which is incorporated herein by reference in its entirety.

BACKGROUND OF THE INVENTION

Despite the current popularity of hockey, television viewing is hampered by the poor visibility of the hockey puck as it moves around the ice at high speeds. In order to be able to view all areas of the ice rink, cameras must be located far from the ice rink. Thus, a standard hockey puck tends to appear as a small dot on the screen. As a result, it is difficult to follow the puck as it is passed from player to player, and it is especially difficult to follow the puck as it is shot toward the goal and either deflected, caught or missed by the goalie. Often, viewers recognize a score only when a signal light is lit or the announcer informs the viewer that a goal has been scored.

U.S. Pat. No. 5,564,698 discloses a hockey puck including electromagnetic transmitters. The transmitters transmit a signal, for example an IR signal, which is captured in one or more sensors around the ice rink. The sensors are able to locate the instantaneous position of the hockey puck, which permits enhancement of the image of the puck on a television monitor. It is important that the transmitters within the puck not affect the overall dimensions of the puck, or the performance of the puck, such as its feel when struck and its reaction when received on a stick or bouncing off a surface.

SUMMARY OF THE INVENTION

Embodiments of the present technology relate to a hockey puck including an internal transmitter enabling instantaneous identification of its position as it moves around. In embodiments, the puck is comprised of two molded subcomponents, which encapsulate a signal transmitter and are sealed together to form the hockey puck. The signal transmitter may include driver electronics and a number of signal transmitters which together generate and emit an electromagnetic signal. In one embodiment, the electromagnetic signal may be infrared (IR) light emitted by a plurality of diodes mounted in openings in the subcomponents, for example around an outer circumference of the hockey puck and through a top and bottom surfaces of the hockey puck. In still further embodiments, the puck may be formed of a material that allows electromagnetic radiation to be emitted through the subcomponents, and the diode cavities may be omitted.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 13 a top view of a hockey puck according to embodiments of the present invention.

FIG. 14 is a cross-sectional view through line 14-14 of FIG. 13.

FIG. 15 is a cross-sectional view through line 15-15 of FIG. 13.

FIG. 16 is a top view of a bottom subcomponent according to the third embodiment.

FIG. 17 is a cross-sectional view through line 17-17 of FIG. 16.

FIG. 18 is a cross-sectional view through line 18-18 of FIG. 16.

FIG. 22 illustrates an alternative configuration of subcomponents of a hockey puck according to a further embodiment of the present invention.

FIG. 25 illustrates an alternative configuration of subcomponents of a hockey puck according to a further embodiment of the present invention.

FIG. 28 illustrates an alternative configuration of subcomponents of a hockey puck according to a further embodiment of the present invention.

FIG. 37 illustrates an alternative configuration of subcomponents of a hockey puck according to a further embodiment of the present invention.

FIG. 45A illustrates a bottom view of a subcomponent of a hockey puck with raised diode headings, according to one embodiment of the present invention.

FIG. 45B is a cross-sectional view through line H-H of FIG. 45A.

FIG. 45C is an enlarged view of area D from FIG. 45B

DETAILED DESCRIPTION

Figure 1:
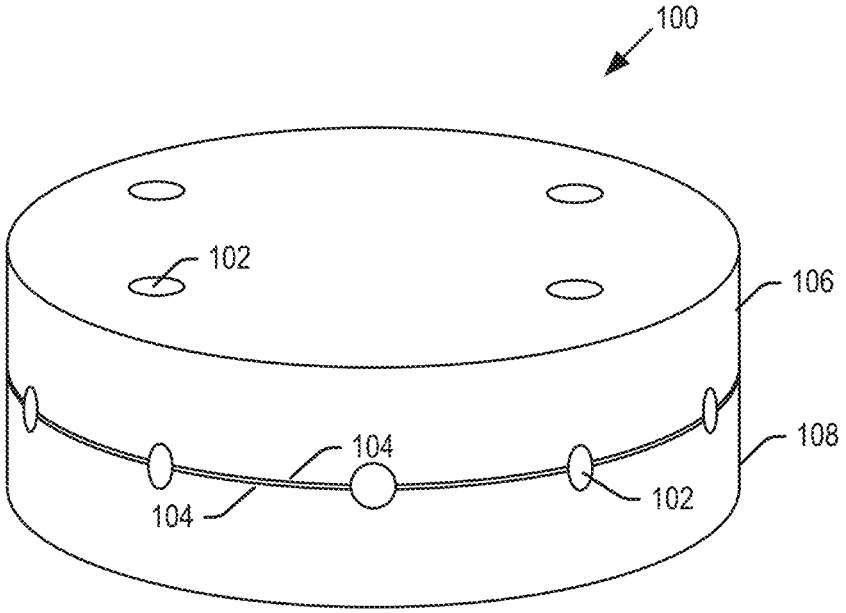
FIG. 1 is a perspective view of a hockey puck according to embodiments of the present invention.

Embodiments of the present technology will now be described with reference to the figures, which in general relate to a hockey puck including an internal signal transmitter enabling instantaneous identification of the puck position as it moves around an ice rink. In embodiments, the puck is comprised of two molded subcomponents, which encapsulate a signal transmitter and fit together to form the hockey puck. The two molded subcomponents may be formed of vulcanized rubber, and may include various features for supporting the signal transmitter and for ensuring a tight and secure fit when the subcomponents are joined together. In embodiments, the subcomponents may be formed of top and bottom halves, or an outer ring surrounding an inner plug.

It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower" and "vertical" and "horizontal," or variations thereof, as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.25%.

The signal transmitter may include a printed circuit board with driver electronics, power source and a number of signal transmitters which together generate and emit an electromagnetic signal. In one embodiment, the electromagnetic signal may be infrared (IR) light emitted by a plurality of diodes around an outer circumference of the hockey puck and through top and bottom surfaces of the hockey puck. Other wavelengths of electromagnetic energy may be used in further embodiments. In embodiments, the printed circuit board and diodes may be encased within a capsule, but the capsule may be omitted in further embodiments.

In embodiments using diodes, the subcomponents may be formed with openings around the outer circumference and top and bottom surfaces for receiving the diodes. The openings allow ends of the diodes to extend to the outer surface of the puck to enable signal emission from the puck. In embodiments where the diodes are encased within a capsule recessed within the puck, signals from the diodes may be communicated from the diodes to the outer surface of the puck by light pipes provided in the openings in the subcomponents. In still further embodiments, the puck may be formed of a material that allows electromagnetic radiation to be emitted through the subcomponents, and the diode openings may be omitted.

The physical characteristics of the puck of the present technology may be the same as a conventional puck without a signal transmitter. Thus, the composition of the subcomponents may be customized for each embodiment of the signal transmitter. The physical characteristics may for example include the look, feel, size and weight of the puck. The physical characteristics may further include the performance of the puck, such as its feel and reaction when caught, struck or passed, and its reaction when bouncing off a surface.

FIG. 1 illustrates a perspective view of an exterior of a hockey puck 100 according to embodiments of the present technology. With the exception of holes 102 for the emission of an electromagnetic signal, and an embossed seam 104 (both of which are explained below), the exterior appearance and physical characteristics of puck 100 may match that of a conventional hockey puck, such as for example those used in the U.S. National Hockey League. Puck 100 may have a cylindrical shape, with a 1 inch thickness and a 3 inch circular diameter. Although not shown in FIG. 1, the outer circumference of puck 100 may include a dimple pattern as in a conventional hockey puck to increase friction between the puck 100 and a hockey stick handling, passing and shooting the puck.

As explained below, puck 100 may house a signal transmitter. As such, subcomponents of the puck 100 may be molded, and then assembled together with the signal transmitter encased within an interior of the puck 100. In the embodiment shown in FIG. 1, subcomponents 106 and 108 comprise upper and lower cylindrical halves which may be affixed together around the signal transmitter, for example in a glue process explained below. Each of the subcomponents 106, 108 may be formed of vulcanized rubber and, in one embodiment, may be fabricated by Soucy Baron Inc., having an office in Saint-Jerome, Canada. The subcomponents 106, 108 may be formed of other materials and fabricated by other companies in further embodiments. The subcomponents 106, 108 may include the same materials as those used in the fabrication of a conventional hockey puck (natural rubber, oils, minerals and carbon black).

However, as explained below, the ratios of the various materials may be adjusted relative to those used in a conventional hockey puck to provide the same performance as a conventional hockey puck despite the hollow core and signal transmitter encased therein. In addition to or instead of varying the ratio of the puck materials, the cure time and/or temperature at which the subcomponents 106, 108 are formed may vary relative to that of a conventional hockey puck to provide the same performance as a conventional hockey puck.

Figure 2:
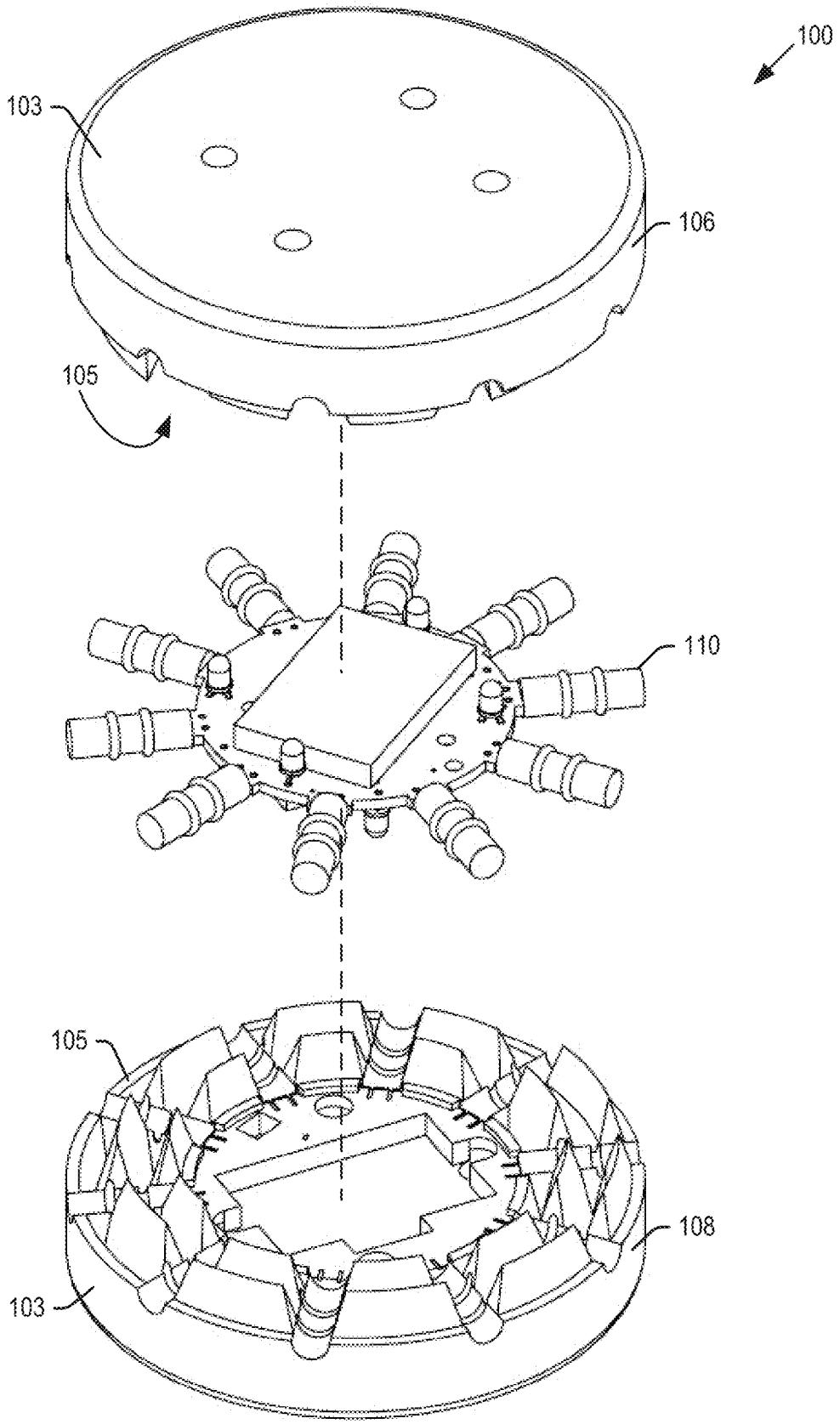
FIG. 2 is an exploded perspective view of a first embodiment of a hockey puck according to the present invention.

FIG. 2 shows an exploded perspective view of a first embodiment of a hockey puck 100. The hockey puck 100 of this embodiment may include top and bottom subcomponents 106 and 108, respectively, and a signal transmitter 110 housed therebetween. Each of the subcomponents 106, 108 includes an exterior surface 103 visible when the subcomponents are sealed together to form the finished hockey puck, and an interior surface 105 that is not visible after the subcomponents are sealed together.

The signal transmitter 110 emits electromagnetic radiation from the different surfaces of the puck 100, which radiation is detected by sensors around the ice rink regardless of the orientation of the puck 100. The sensors are able to locate the instantaneous position of the hockey puck, which permits enhancement of the image of the puck on a television monitor. For example, the puck may be highlighted in different colors, or different-colored contrails may be shown behind the puck, as it is shot, passed, leaves the ice surface or enters the goal.

Details of the electronics and components of signal transmitter 110 are disclosed for example in U.S. Pat. No. 5,564,698, entitled "Electromagnetic Transmitting Hockey Puck." However, referring now to the perspective view of FIG. 3, signal transmitter 110 may generally include a printed circuit board (PCB) 114 having driver electronics formed on top and bottom surfaces of the PCB 114. The signal transmitter 110 may further include a power source 112 such as a rechargeable battery.

In embodiments, the signal transmitter 110 may further include a number of diodes 120 (some of which are numbered in FIG. 3) which generate and emit electromagnetic radiation under the control of the driver electronics on PCB 114. The diodes 120 may emit electromagnetic radiation outside of the visible light spectrum, such as for example IR light. It is conceivable that diodes 120 emit light in the visible spectrum in further embodiments.

In the embodiment shown, there are a total of eighteen diodes 120: four axially extending diodes **120*a* on a top surface of PCB 114 (to emit a signal from a top surface of the puck), four axially extending diodes 120*b* on a bottom surface of PCB 114 (to emit a signal from a bottom surface of the puck), and ten radially extending diodes 120*c* extending radially from the outer circumference of the PCB 114 (to emit the signal from an outer circumference of the puck). Thus, radiation from the puck may be detected regardless of an orientation of the puck. It is understood that the signal transmitter 110 may include more or less diodes 120 in further embodiments, and diodes in other places than shown. When the puck 100 is fully assembled, outer ends of the diodes 120 (i.e., most distal from the PCB 114) may lie flush with the exterior surfaces 103 of the subcomponents 106, 108**.

Figure 3:
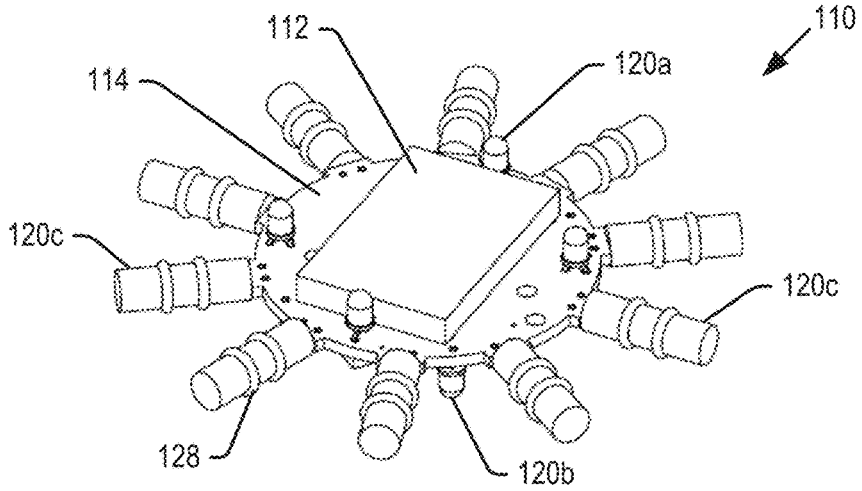
FIG. 3 is a perspective view of an embodiment of a signal transmitter according to the present invention.
Figure 4:
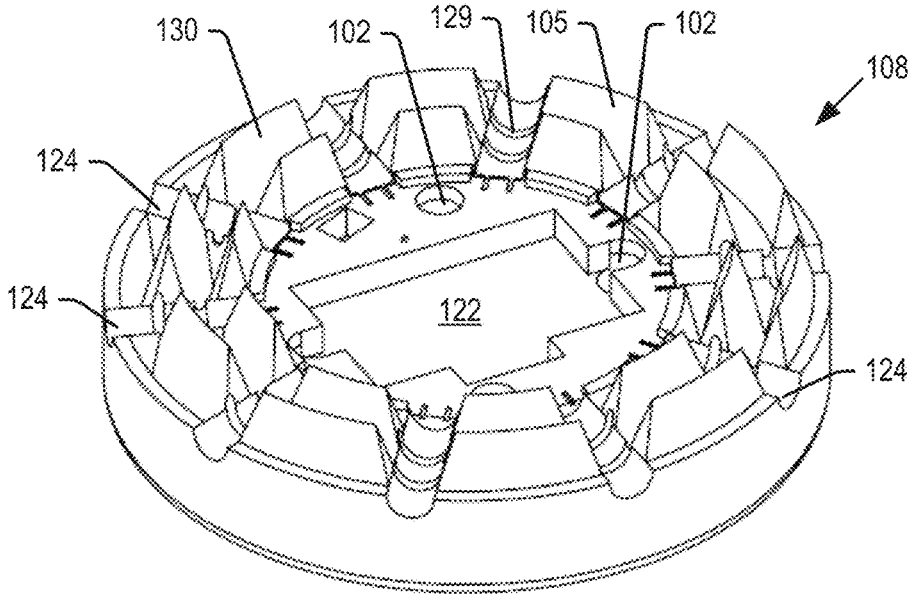
FIG. 4 is a perspective view of an embodiment of a subcomponent of a hockey puck according to the present invention.

As opposed to embodiments described hereinafter, the signal transmitter 110 in the embodiment of FIGS. 2 and 3 is unencapsulated, and interior surfaces 105 of the subcomponents 106, 108 are keyed with features to directly support a battery 112, the printed circuit board 114 and the diodes 120 of the signal transmitter 110. FIG. 4 illustrates interior surfaces 105 of the bottom subcomponent 108 for receiving and supporting the signal transmitter 110. It is understood that the top subcomponent 106 may include similar features for receiving and supporting the signal transmitter 110.

As seen in FIG. 4, the interior surface 105 of subcomponent 108 may include a cavity 122 sized and shaped to receive the battery 112 on a bottom surface of the PCB 114. The interior surface of subcomponent 108 further includes holes 102 (two of which are numbered) for receiving the axially extending diodes 120*b* on a bottom surface of the PCB 114. The interior surface of subcomponent 108 may further include semicircular channels 124 (some of which are numbered) for receiving the radially extending diodes 120*c* around an outer circumference of the PCB 114. The interior surface of subcomponent 106 may have a corresponding set of semicircular channels 124, so that the semicircular channels in the subcomponents 106, 108 together form radiantly extending holes enclosing the diodes 120*c*.

As seen in FIG. 3, the radially extending diodes 120*c* may include ridges 128 (one of which is numbered). These ridges mate within the detents 129 (again, one of which is numbered) in the channels 124 of subcomponent 106, 108. The mating of the ridges 128 within detents 129 provides resistance to the shear forces which are generated when the subcomponents 106, 108 are glued together as explained below. The ridges 128 and detents 129 may be omitted in further embodiments.

The cavities 122, holes 102, channels 124 and other indentations on the interior surfaces 105 of subcomponents 106, 108 allow the subcomponents 106, 108 to fit tightly together with the signal transmitter 110 enclosed snuggly therebetween. With the exception of holes 102 and channels 124, no other indentations formed on the interior surfaces of subcomponents 106, 108 are open to an exterior of the puck 100.

Figure 5:
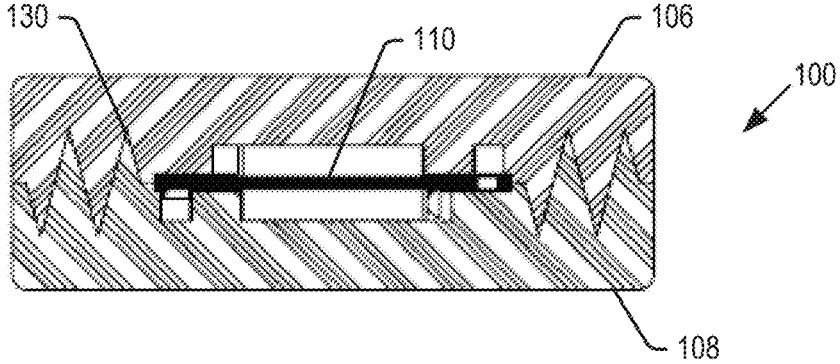
FIG. 5 is a cross-sectional view of a hockey puck according to the first embodiment.

The interior surfaces 105 of subcomponents 106, 108 further include keyed features 130 for ensuring a tight and secure fit of the subcomponents when they are glued to each other. The keyed features 130 may be in a variety of different configurations, some of which are shown in the drawings. In FIGS. 4 and 5, the keyed features 130 include a plurality of wedges arranged in concentric circles. As shown in the cross-section view of FIG. 5, the concentric wedges in the subcomponent 108 are offset from, and complementary to, the concentric wedges in the subcomponent 106. In particular, the peaks of the wedges in subcomponent 108 align with the valleys of the wedges in subcomponent 106, and vice-versa. Thus, when assembled together as shown in the cross-sectional view of FIG. 5, the features 130 on the interior surface 105 of subcomponent 108 mate snugly with the features 130 on the interior surface 105 of subcomponent 106.

The features 130 may have various characteristics. First, the features provide a relatively large surface area for receiving glue as explained below to securely affix the subcomponents 106 and 108 to each other. Second, in embodiments, the features 130 may be sandblasted, or formed within a mold that is sandblasted. The features/mold may alternatively be chemically etched. Sandblasting/chemical etching increases the surface area and provides nooks and crannies for the glue between adjacent surfaces of the features 130 of subcomponents 106, 108. Sandblasting may be omitted in further embodiments. Third, extending vertically, the features 130 are able to exert lateral forces against each other (for example parallel to the top and bottom surfaces of the puck 100) to provide a resistance to shear forces when the subcomponents are affixed together and thereafter.

Figure 6:
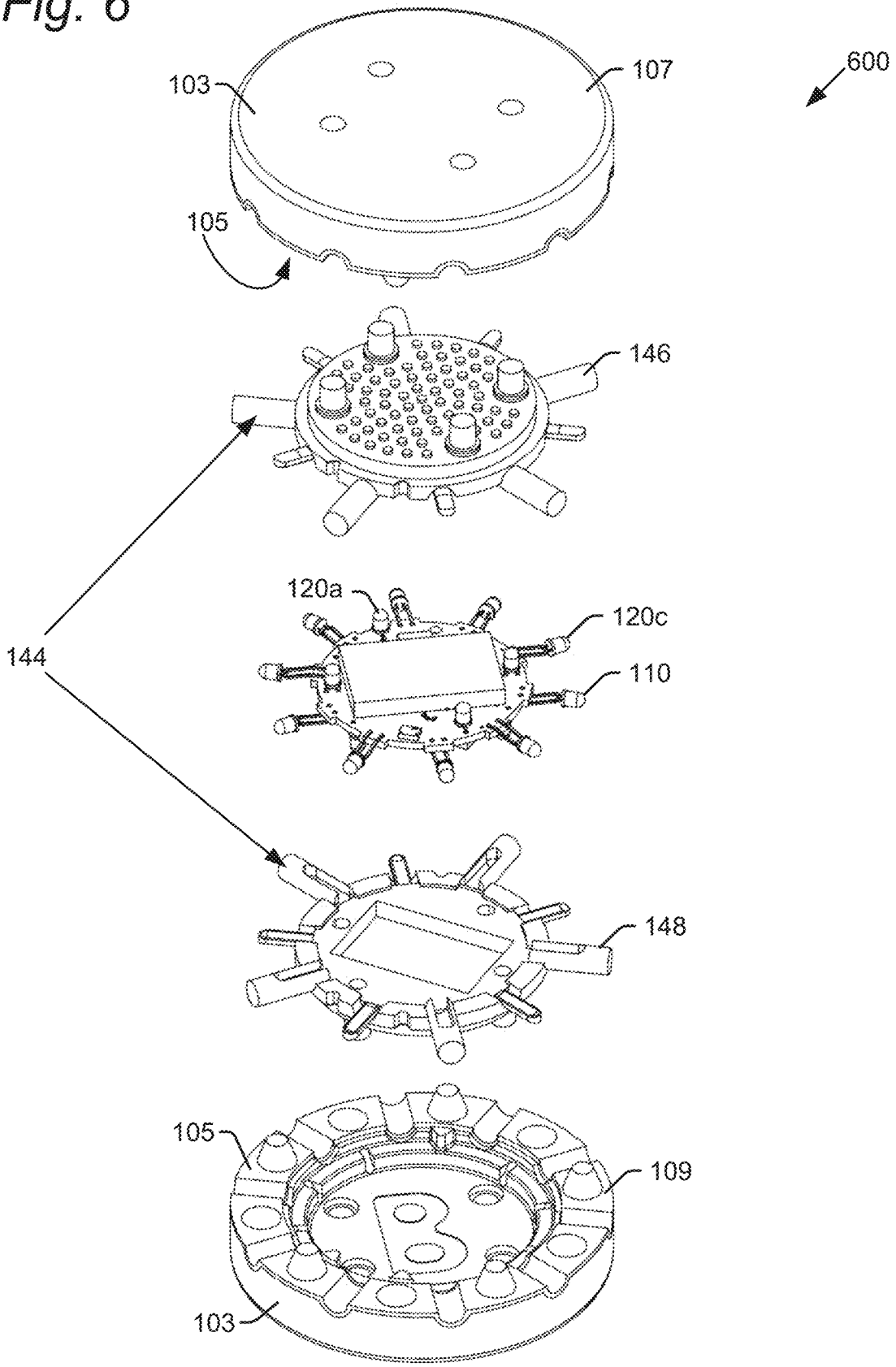
FIG. 6 is an exploded perspective view of a second embodiment of a hockey puck according to the present invention.
Figure 8:
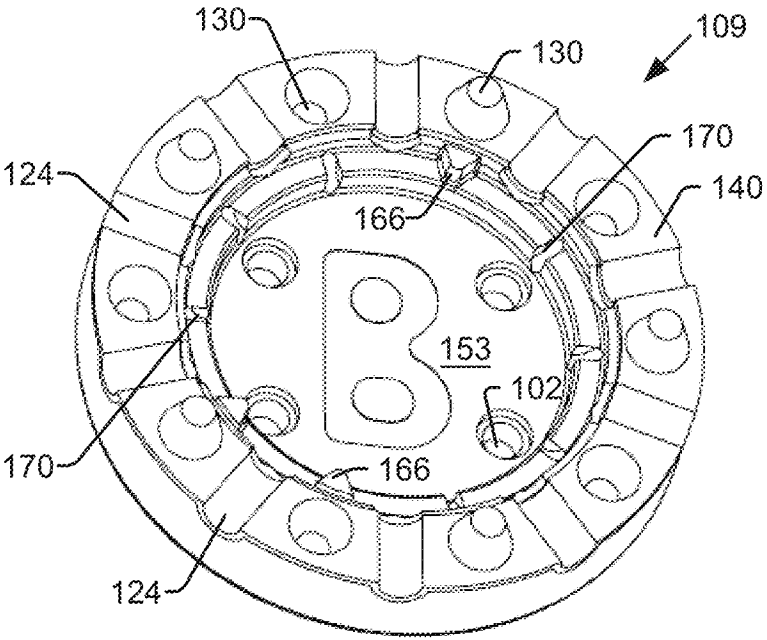
FIG. 8 is a bottom perspective view of one embodiment of subcomponents according to the present invention.
Figure 7:
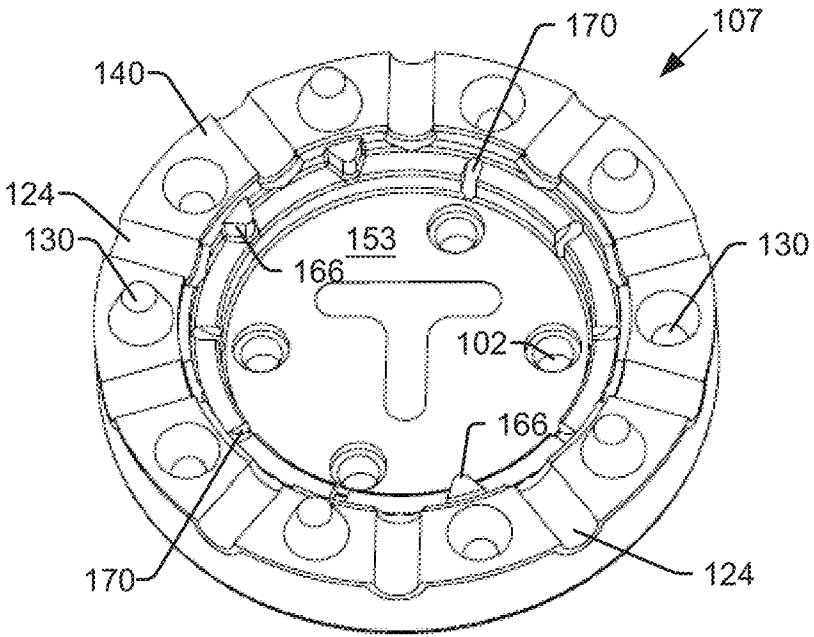
FIG. 7 is a top perspective view of one embodiment of subcomponents according to the present invention.

FIG. 6 shows an exploded perspective view of a puck 600 including an alternative design of the subcomponents 107, 109 and an alternative design of the signal transmitter 110. FIGS. 7 and 8 show perspective views of the interior surfaces 105 of the subcomponents 107, 109 according to the embodiment of FIG. 6. As shown, each subcomponent 107, 109 includes an outer ring 140 having features 130 (some of which are numbered). In this embodiment, the features 130 in each ring 140 may comprise a number of positively extending truncated cones and a number of negatively recessed truncated cones. Full cones may be used instead of truncated cones in further embodiments. Additionally, complementary positively extending and negatively recessed shapes other than cones may be used in further embodiments.

The cones are arranged on the respective rings 140 such that, when the subcomponents 107, 109 are mated together, a positively extending cone mates within a negatively recessed cone in the opposite subcomponent. In the embodiments of FIGS. 7 and 8, each subcomponent includes both positively extending and negatively recessed cones, which mate within their compliment in the opposite subcomponent. In further embodiments, the ring 140 on subcomponent 107 may be all positively extending cones or negatively recessed cones, and the ring 140 on subcomponent 109 may include all of the opposite shape. Thus, the positively extending cones mate within the negatively recessed cones when the subcomponents 107, 109 are mated together. The features 130 on the rings 140 in the embodiment of FIGS. 7 and 8 may include the characteristics described above with respect to the features shown in FIG. 4.

Referring again to the exploded perspective view of FIG. 6, this embodiment may include a signal transmitter 110 that may be encased within a capsule 144 comprised of sub-capsule halves 146 and 148. Sub-capsule halves 146, 148 may for example be formed of molded silicone (or other encapsulant) and may completely enclose the signal transmitter 110 when the halves 146, 148 are assembled together.

Figure 9:
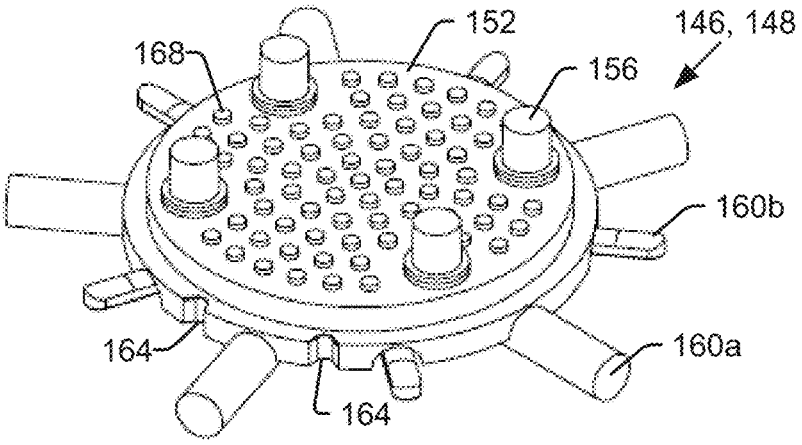
FIG. 9 is a perspective of a section of a capsule for encapsulating the signal transmitter according to one embodiment of the present invention.
Figure 10:
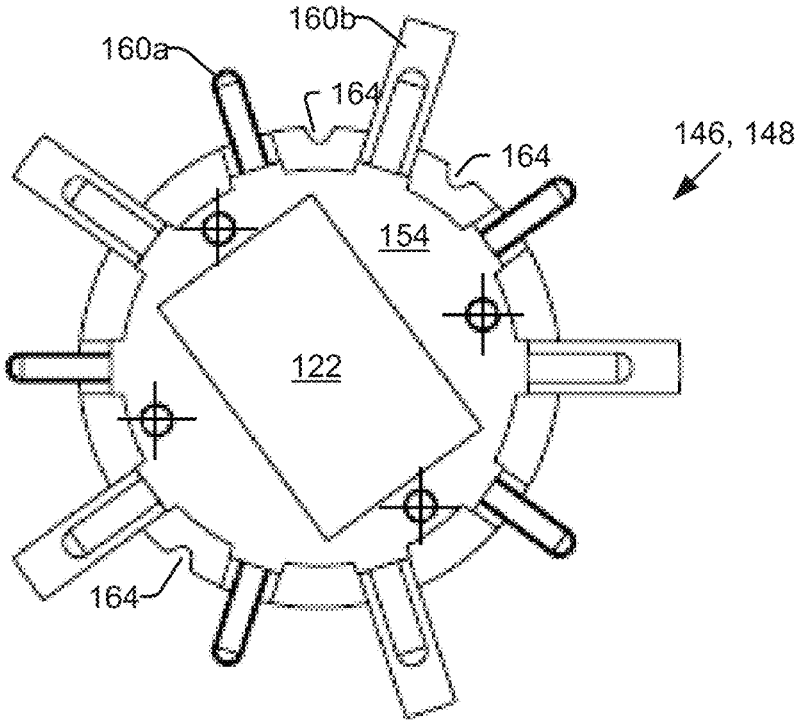
FIG. 10 is a top view of a section of a capsule for encapsulating the signal transmitter according to one embodiment of the present invention.

FIGS. 9 and 10 illustrate a perspective view of an exterior surface 152 and a top view of an interior surface 154 of sub-capsule halves 146, 148. The halves 146, 148 may be identical to each other, with the exception that components in the half 146 may be rotated off axis with respect to the corresponding components in the half 148, as explained below.

Figure 11:
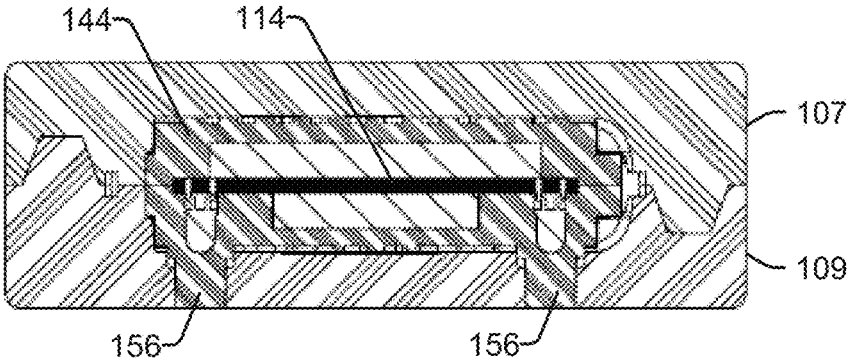
FIG. 11 is a cross-sectional view of a hockey puck according to the second embodiment.

The capsule 144 includes light pipes 156 and 160 for receiving diodes 120 and for communicating the electromagnetic radiation from diodes 120 to the exterior surface 103 of the hockey puck 100. Each sub-capsule half 146, 148 includes axially extending light pipes 156 (FIGS. 9 and 11) extending from exterior surface 152. These axially extending light pipes in respective halves 146, 148 receive the axially extending diodes 120*a*, 120*b* extending from the top and bottom surfaces, respectively, of the PCB 114. The light pipes 156 in turn fit through holes 102 in the subcomponents 107, 109 to be flush with the exterior surface 103 of the subcomponents 107, 109.

The capsule 144 may further include radially extending light pipes 160 extending from an outer circumference of capsule 144. The radially extending light pipes 160 in capsule 144 receive the radially extending diodes 120*c* extending from the outer circumference of the PCB 114. Each of the radially extending light pipes 160 is formed of two mating pieces, with a first piece formed in sub-capsule half 146 and a second, complementary piece formed in sub-capsule half 148. The two pieces fit together around diodes 120*c* when the sub-capsule halves 146, 148 are brought together. The light pipes 160 in turn fit within channels 124 in the subcomponents 107, 109 to be flush with the exterior surface 103 of the subcomponents 107, 109.

The first and second pieces in respective halves may have the same configuration, each forming one-half of the light pipe 160. However, in other embodiments, the pieces may be dissimilar. For example, in FIGS. 9 and 10, one piece (160*a*) is larger than the complementary piece (160*b*) in the other sub-capsule half. In the embodiment shown in FIGS. 9 and 10, the radially extending diodes 120*c* may fit within the piece 160*a* and the piece 160*b* may act as a cover to encase the diodes 120*c*. In embodiments where the pieces are dissimilar, a sub-capsule half 146, 148 may have both larger pieces 160*a* and smaller pieces 160*b*, and the other sub-capsule half may have the complementary smaller pieces 160*b* and larger pieces 160*a*. Alternatively, one sub-capsule half may have all of one type of piece (for example 160*a*) and the other sub-capsule half may have all of the other type of piece (for example 160*b*).

The sub-capsule halves may each have a cavity 122 for receiving the battery 112 as described above. The subcomponents 107, 109 may each include a recess 153 (FIGS. 7 and 8). The recesses 153 define a central void within the interior of the puck 600 when the subcomponents 107, 109 are brought together. The central void defined by recesses 153 is sized and shaped to snugly receive the capsule 144.

The capsule 144 includes notches 164 as shown for example in FIGS. 9 and 10. The notches 164 are positioned so that there is a single rotational orientation, and a single side facing upward, where the notches 164 align with and fit over raised key-points 166 in the subcomponents 107, 109 (FIGS. 7 and 8). Proper alignment of the raised key-points 166 in the notches 164 ensures the capsule 144 is properly seated between the subcomponents in the proper orientation and with the proper side of the capsule facing upward. In particular, there are two key-points on one side of the subcomponents, and one on the opposite side, which together form a triangle that is not an equilateral triangle. Thus, the key-points define a unique orientation and one side facing upward where the notches 164 in the capsule 144 fit over the key-points.

Exterior surfaces of the sub-capsule halves 146, 148 may include dimples 168 (FIG. 9) which increase the surface area for receiving glue, and provide shear resistance against lateral movement of the capsule 144 in the subcomponents 107, 109 during the gluing process. As seen in FIGS. 7 and 8, the subcomponents 107, 109 may further include weep holes 170 which provide channels for seepage of the glue out of the cavities 153 when the subcomponents are affixed together as explained below.

Figure 12:
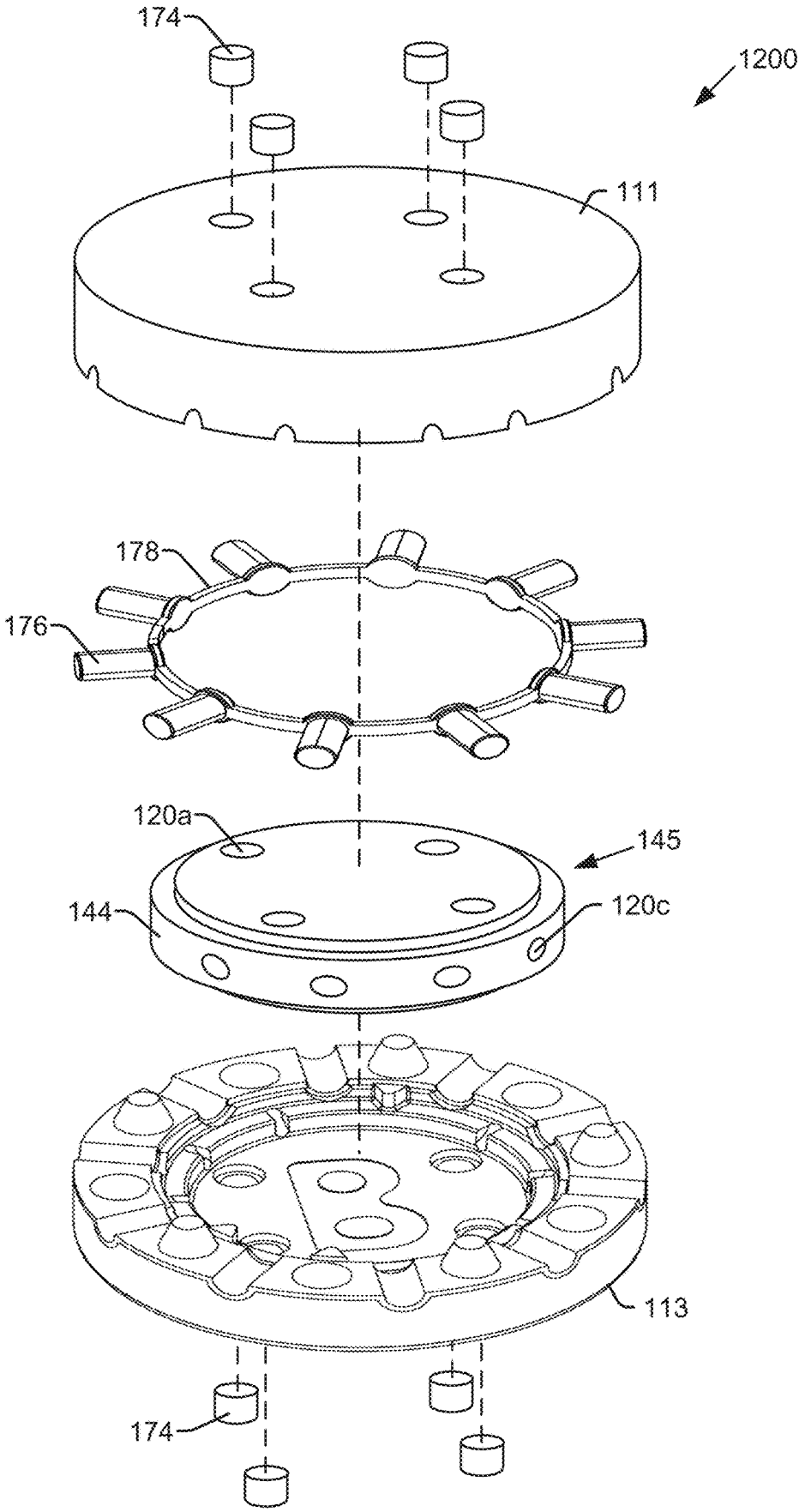
FIG. 12 is an exploded perspective view of a third embodiment of a hockey puck according to the present invention.

FIGS. 12-18 illustrate a further embodiment of the hockey puck according to the present technology. FIG. 12 illustrates an exploded perspective view which is similar to the embodiment shown in FIG. 6, with one difference being that the capsule 144 is preassembled prior to placing the capsule 144 between the subcomponents 111, 113. The capsule 144 shown in FIG. 12 may be identical to the capsule 144 shown in FIG. 6. However, instead of having two separate sub-capsule halves encasing the signal transmitter 145, the signal transmitter 145 including the PCB 114 and diodes 120 may be put in a mold and encased in a single-piece capsule 144 of silicone (or other encapsulant). Thus, the capsule 144 and signal transmitter 145 may be a single integrated unit when assembled between the subcomponents 111, 113.

In order to communicate the electromagnetic radiation from the diodes 120 within the capsule 144, the embodiment of FIG. 12 may further include light pipes 174 and 176. In the embodiment of FIG. 6, the light pipes 156, 160 were integrally formed on the capsule 144. In the embodiment of FIG. 12, the light pipes 174, 176 may be silicone (or other like material) that are molded separately from the capsule 144.

Further details of the puck 1200 of the embodiment of FIG. 12 are shown in the top and cross-sectional views of FIGS. 13-15. FIGS. 14 and 15 are cross-sectional views of the hockey puck 1200, through lines 14-14 and 15-15, respectively, in FIG. 13. The axial light pipes 174 may be plugs that fit within holes 102 in the subcomponents 111, 113. As shown for example in FIGS. 12 and 15, axial light pipes 174 may have a length so that a first end of a light pipe 174 lies against the capsule 144 (over an encased diode 120*a*, 120*b*) and a second, opposite end lies flush with the exterior surface 103 of the subcomponents 111, 113.

As seen for example in FIGS. 12 and 14, the radial light pipes 176 may be molded together on a ring 178. The ring 178 may fit snugly over an outer circumference of the capsule 144, with first ends of the radial light pipes 176 aligned with and lying over the encased diodes 120*c*. The radial light pipes 176 may lie in channels 126, and may have a first end against the capsule 144 and a second, opposite end flush with the exterior surface 103 of the subcomponents 111, 113. In this way, the light pipes 174, 176 transmit the electromagnetic radiation from the diodes 120 to the exterior of the puck 1200. The capsule 144 may include notches 164 (not shown in FIGS. 12-18) which receive raised key-points 166 to ensure the capsule is properly oriented, with the correct side facing upward, so that the light pipes 174, 176 align with their respective diodes 120.

Further details of the subcomponents 111, 113 of the embodiment of FIG. 12 are shown in the top and cross-sectional views of FIGS. 16-18. FIGS. 17 and 18 are cross-sectional views through lines 17-17 and 18-18, respectively, in FIG. 16. In general, the subcomponents 111, 113 of the embodiment of FIG. 12 may have the same features as the subcomponents 111, 113 described above the respect to FIG. 6. These features include for example recess 153 with holes 102, and a ring 140 including channels 124 and features 130 in the form of positively extending and negatively recessed truncated cones. The subcomponents 111, 113 may further include weep holes 170. Each of these components may be structurally and operationally similar to the like components described above with respect to the embodiment in FIG. 6.

While the embodiment of FIG. 6 is described and shown with light pipes integrally formed on capsule 144, it is understood that the embodiment of FIG. 6 may have separate light pipes as shown and described above with respect to FIG. 12. In a further example, instead of being formed on a separate ring 178, the light pipes 174 and/or 176 may be integrally formed on the capsule 144 in the embodiment of FIG. 12. Light pipes integrally formed on the capsule may have an advantage that they are able to better withstand the hydrostatic forces generated during the gluing process explained below, so that they do not get pushed out of the holes 102 and channels 124.

Figure 19:
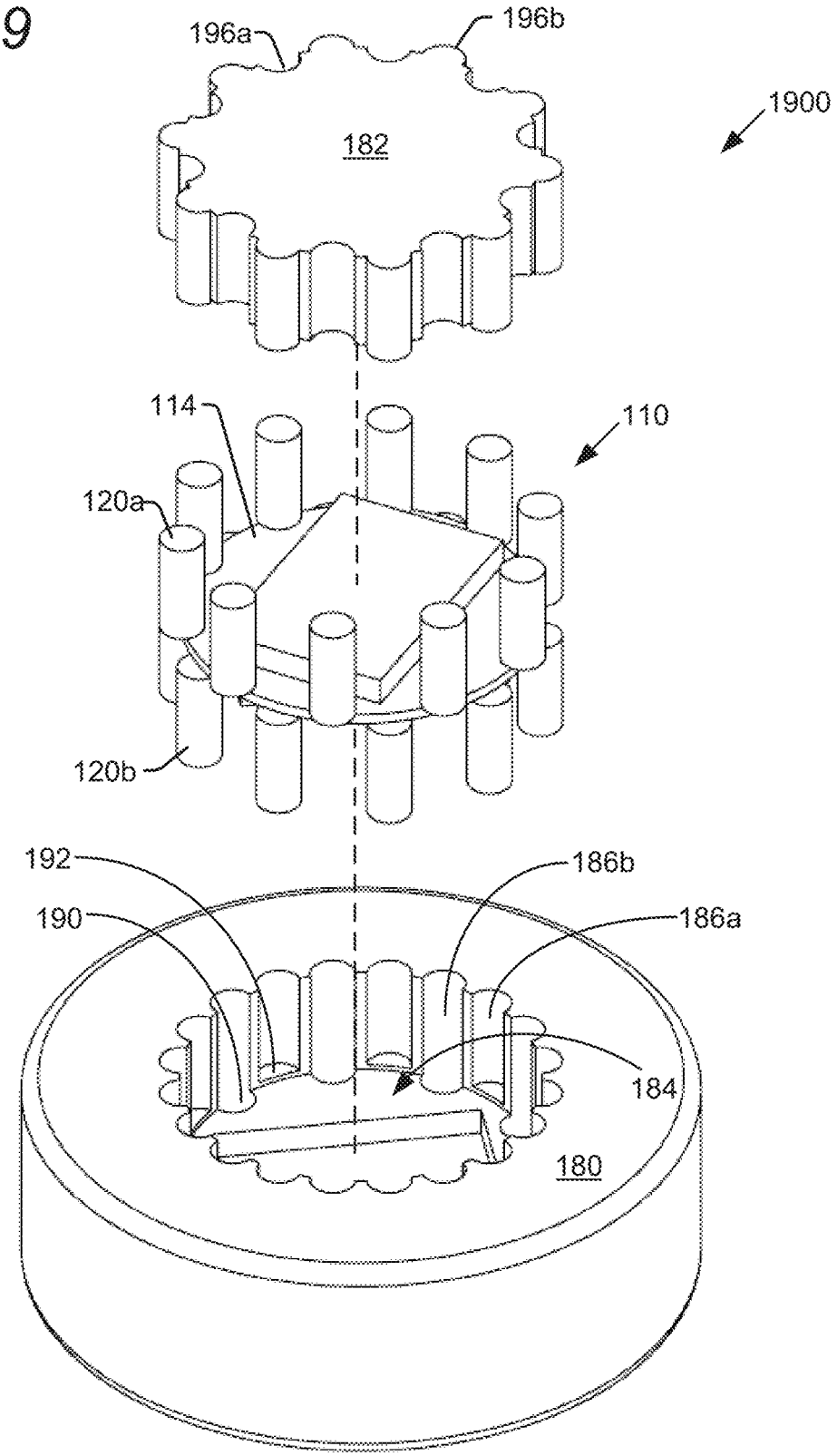
FIG. 19 is an exploded perspective view of a fourth embodiment of a hockey puck according to the present invention.
Figure 20:
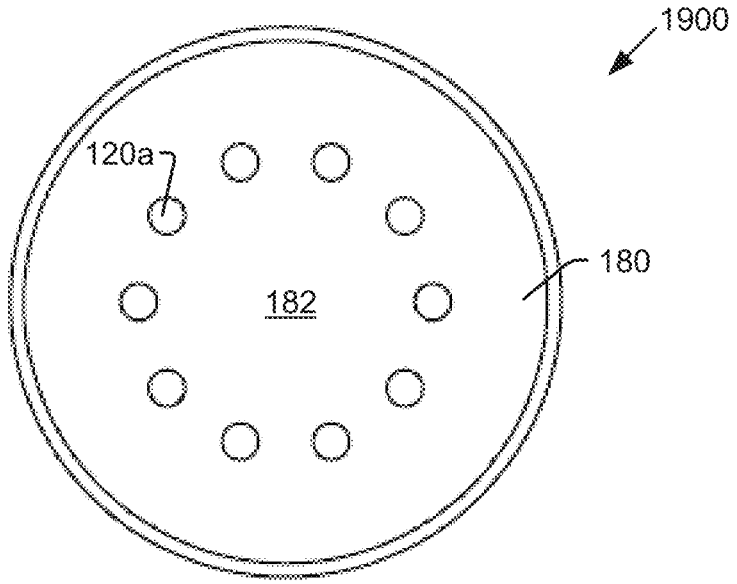
FIG. 20 a top view of a hockey puck according to the fourth embodiment of the present invention.
Figure 21:
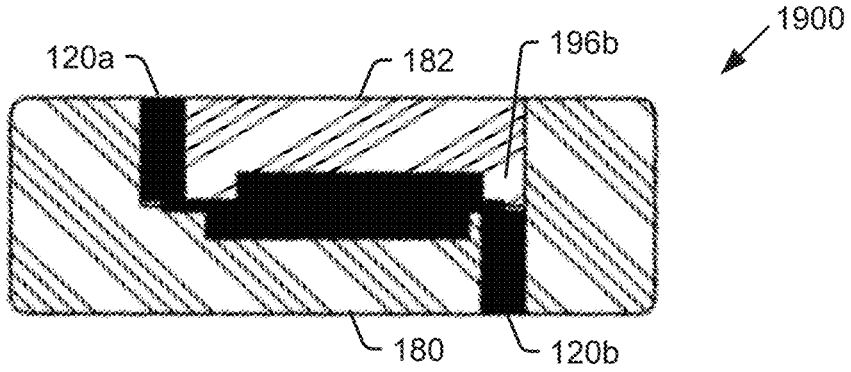
FIG. 21 a cross-sectional view of a hockey puck according to the fourth embodiment of the present invention.
Figure 23:
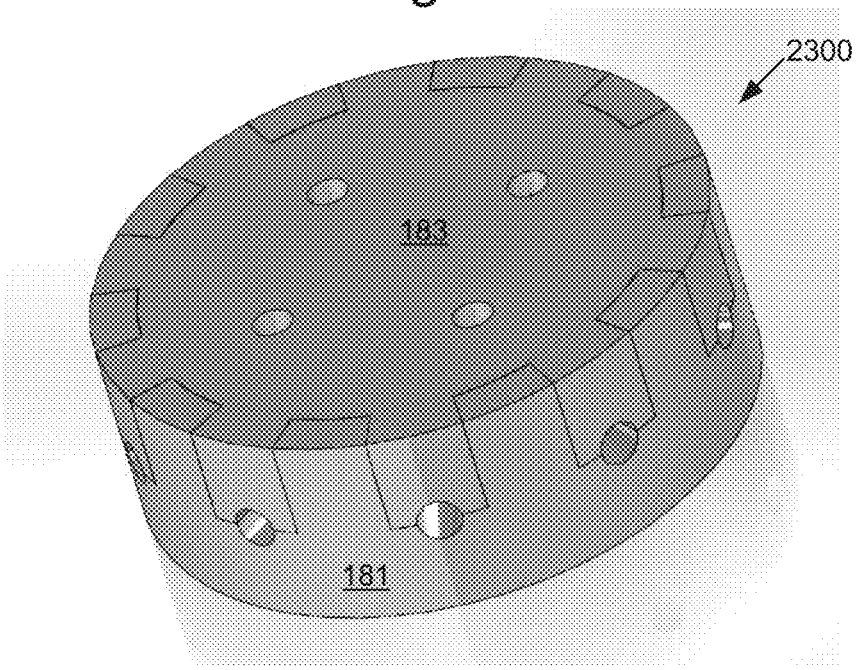
FIG. 23 illustrates an alternative configuration of subcomponents of a hockey puck according to a further embodiment of the present invention.
Figure 24:
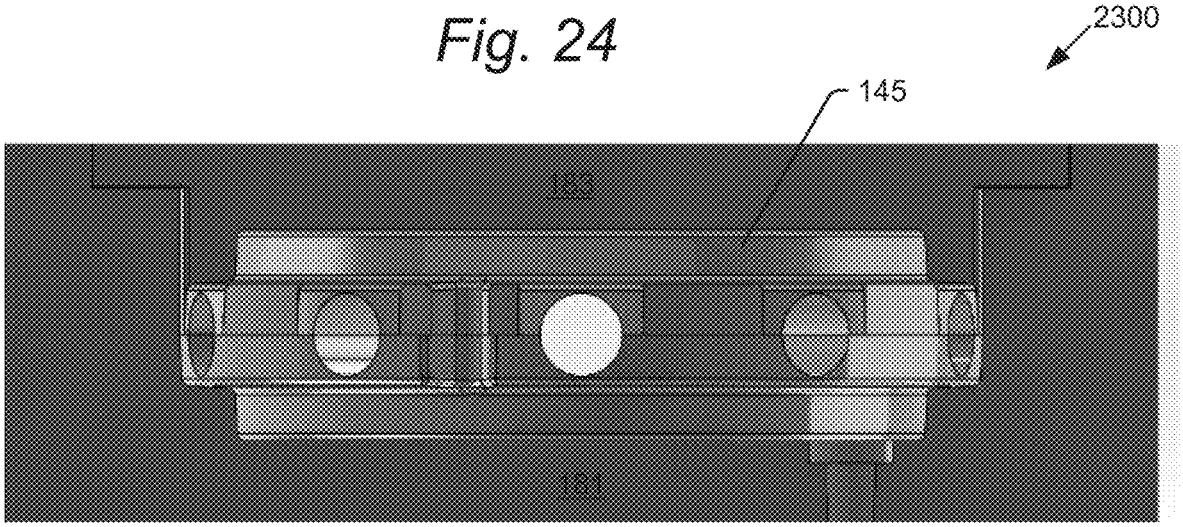
FIG. 24 illustrates an alternative configuration of subcomponents of a hockey puck according to a further embodiment of the present invention.

In embodiments described thus far, subcomponents described are top and bottom halves of the hockey puck. FIGS. 19-21 illustrate a further embodiment of the hockey puck 1900 including a subcomponent 180 comprising the bottom portion of the puck 1900. Subcomponent 180 comprises a larger piece, e.g., a base, and includes the bottom surface of the puck 1900, the rounded circumferential edge of the puck 1900, and a portion of the top surface of the puck 1900. Subcomponent 182 comprises a smaller piece, e.g., a cover, filling in the remainder of the top surface of puck 1900. The edges of the cover and bottom portion of the puck abut with a toothed design. Thus, where the embodiments of FIGS. 1-18 have a lip (embossed seam 104) in the puck 1900 around rounded circumferential edge of the puck 1900, the embodiment of FIGS. 19-21 have a seam on the top planar surface of the puck (or on the bottom planar surface where the subcomponents 180, 182 are switched).

In the embodiment of FIGS. 19 and 20, the signal transmitter 110 includes axial diodes 120*a* and 120*b* on top and bottom surfaces, respectively, of PCB 114. The subcomponent 180 includes an opening 184 for receiving signal transmitter 110. Opening 184 may have circumferential edges defined by channels 186*a* and 186*b*. The channels 186*b* receive and mate with the downwardly extending diodes 120*b*. The bottom portion 190 of channels 186*b* is open to the exterior surface of the puck 1900 so that electromagnetic radiation from diodes 120*b* may be omitted from a bottom surface of the puck 1900.

The channels 186*a* receive and mate with the upwardly extending diodes 120*a*. A bottom portion 192 of the channels 186*a* may be sealed. The subcomponent 182, referred to hereinafter as cover 182, includes a number of axial recesses 196*a* and axial protrusions 196*b* around its outer circumference. The recesses 196*a* align with channels 186*a* and, together with the channels 186*a*, enclose the upwardly extending diodes 120*a* along their lengths when cover 182 is sealed within the opening 184. The recesses 196*a* and channels 186*a* are open at an upper surface of the puck 1900 to allow emission of electromagnetic radiation from diodes 120*a* at the upper surface, as shown in the top view of puck 1900 in FIG. 20.

The protrusions 196*b* align with and fill channels 186*b*. As shown in the cross-sectional view of FIG. 21, when the cover 182 is sealed within the opening 184, the protrusions 196*b* axially align over the diodes 120*b* and seal the channels 186*b* above the diodes 120*b*.

FIGS. 22-39 are edge and perspective views of subcomponent configurations according to a variety of alternative embodiments. FIGS. 21-24 illustrate subcomponents 181, 183 which form a seam extending to a top portion of the puck 2300 and around a circumferential edge of the hockey puck 2300.

Figure 26:
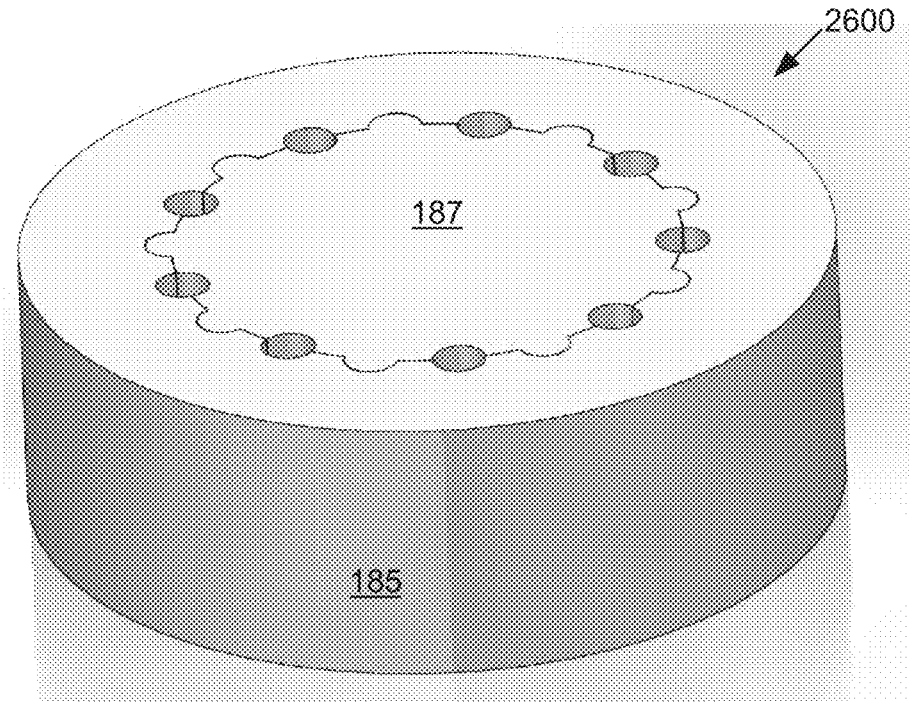
FIG. 26 illustrates an alternative configuration of subcomponents of a hockey puck according to a further embodiment of the present invention.
Figure 27:
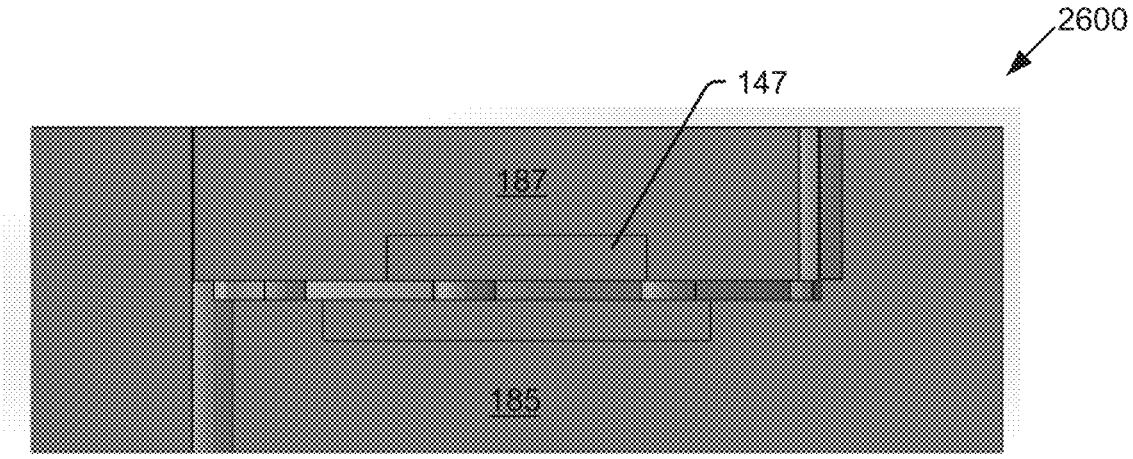
FIG. 27 illustrates an alternative configuration of subcomponents of a hockey puck according to a further embodiment of the present invention.

FIGS. 25-27 illustrate embodiments of subcomponents 185, 187 forming puck 2600 is similar to those described above the respect to FIGS. 19-21, but the spacing of the different sections forming the vertical walls at an interface between subcomponents 185, 187 is slightly different.

Figure 29:
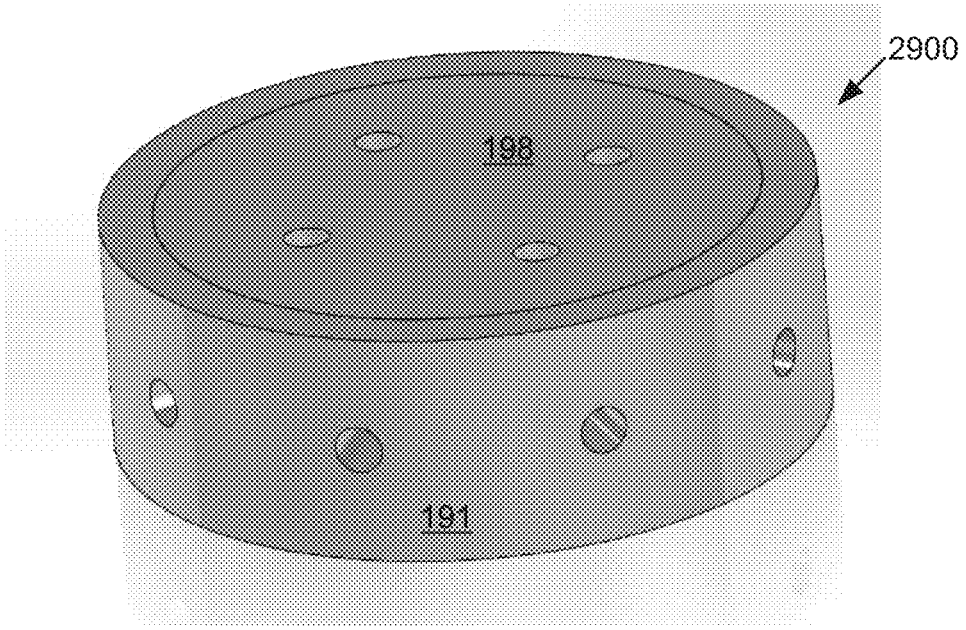
FIG. 29 illustrates an alternative configuration of subcomponents of a hockey puck according to a further embodiment of the present invention.
Figure 30:
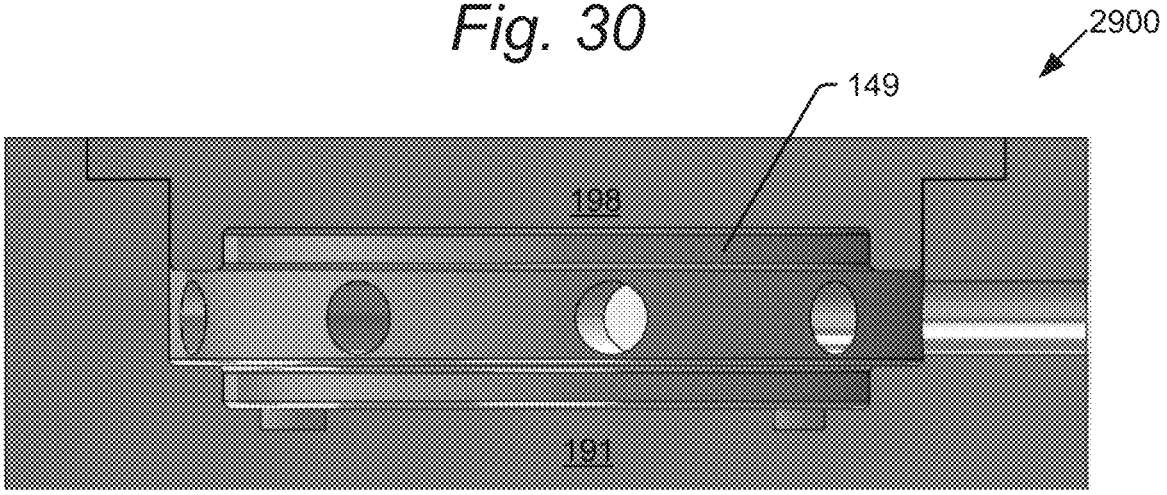
FIG. 30 illustrates an alternative configuration of subcomponents of a hockey puck according to a further embodiment of the present invention.
Figure 31:
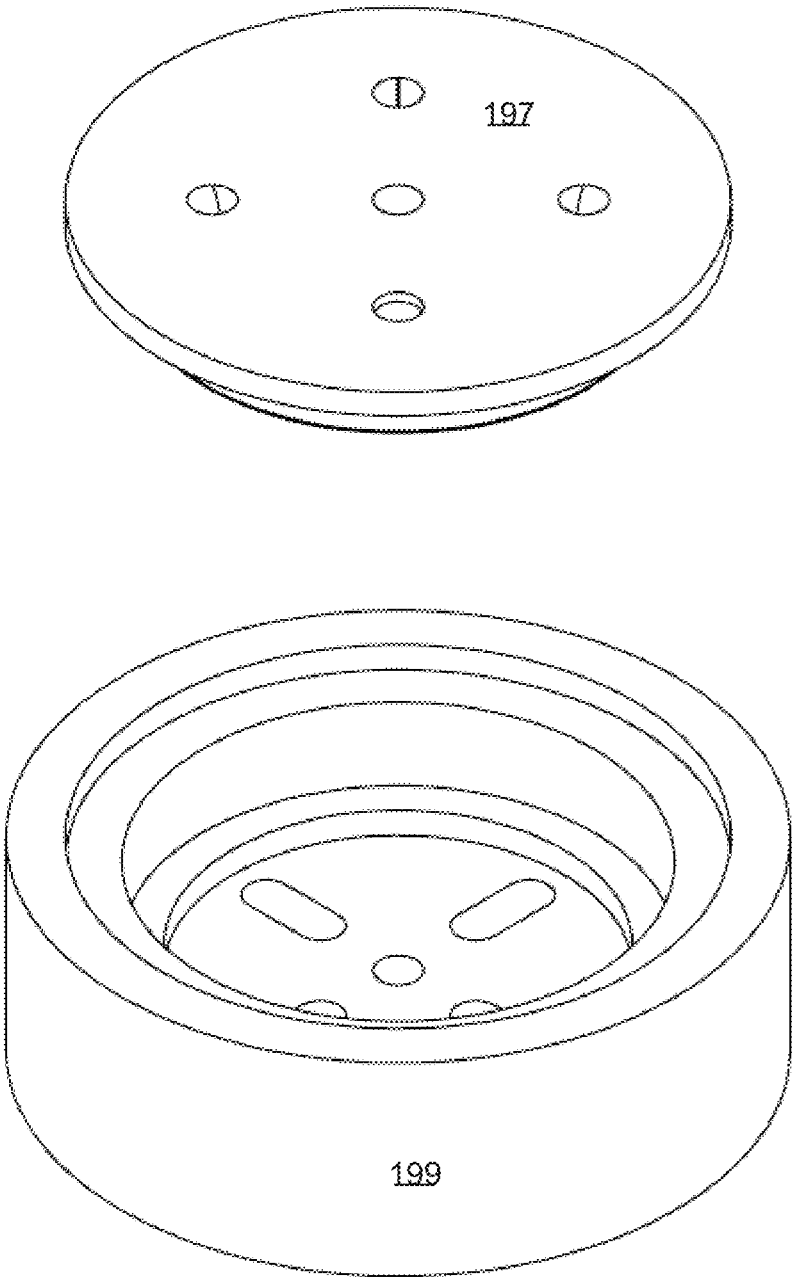
FIG. 31 illustrates an alternative configuration of subcomponents of a hockey puck according to a further embodiment of the present invention.
Figure 32:
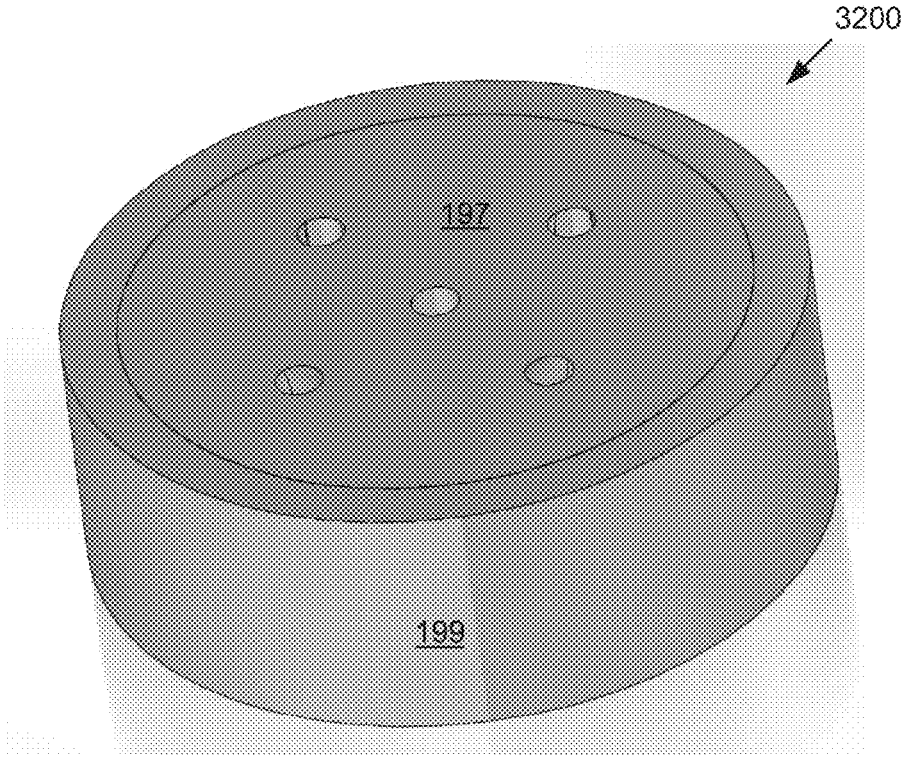
FIG. 32 illustrates an alternative configuration of subcomponents of a hockey puck according to a further embodiment of the present invention.
Figure 33:
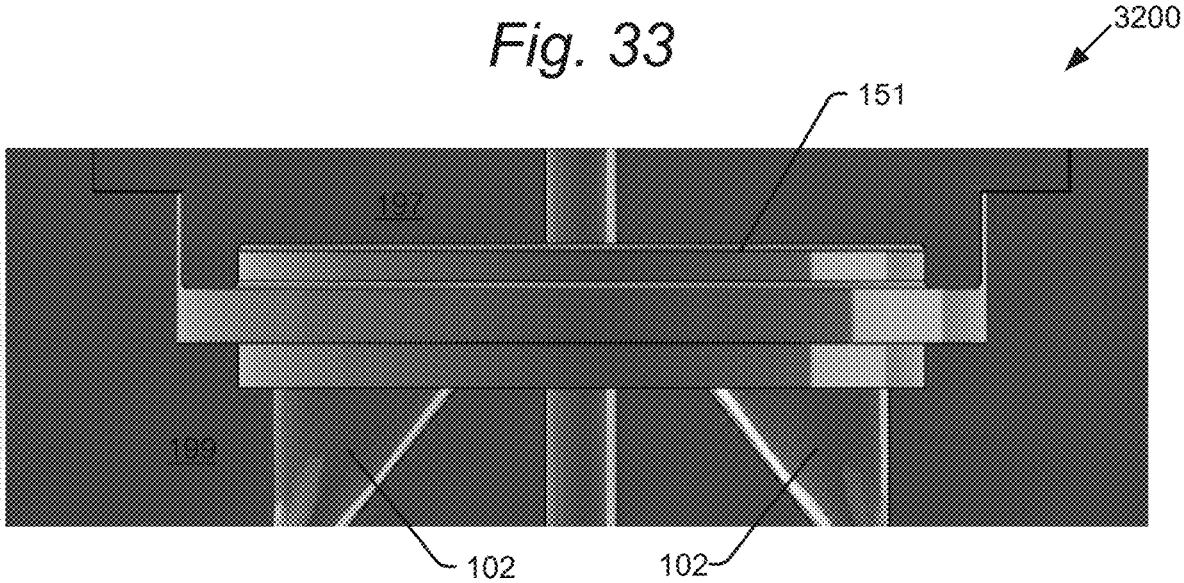
FIG. 33 illustrates an alternative configuration of subcomponents of a hockey puck according to a further embodiment of the present invention.

FIGS. 28-30 illustrate embodiments of subcomponents 191, 198 forming a seam on upper surface of the hockey puck 2900. In this embodiment, the upper subcomponent 198 includes an interior facing flange 193 that seats against a surface 194 in the lower subcomponent 191. The embodiments of the puck 3200 of FIGS. 31-33 are similar to that of FIGS. 28-30, but the lower subcomponent 199 includes elongated holes 102 which taper toward a bottom surface of the subcomponent 199 and away from upper subcomponent 197.

Figure 34:
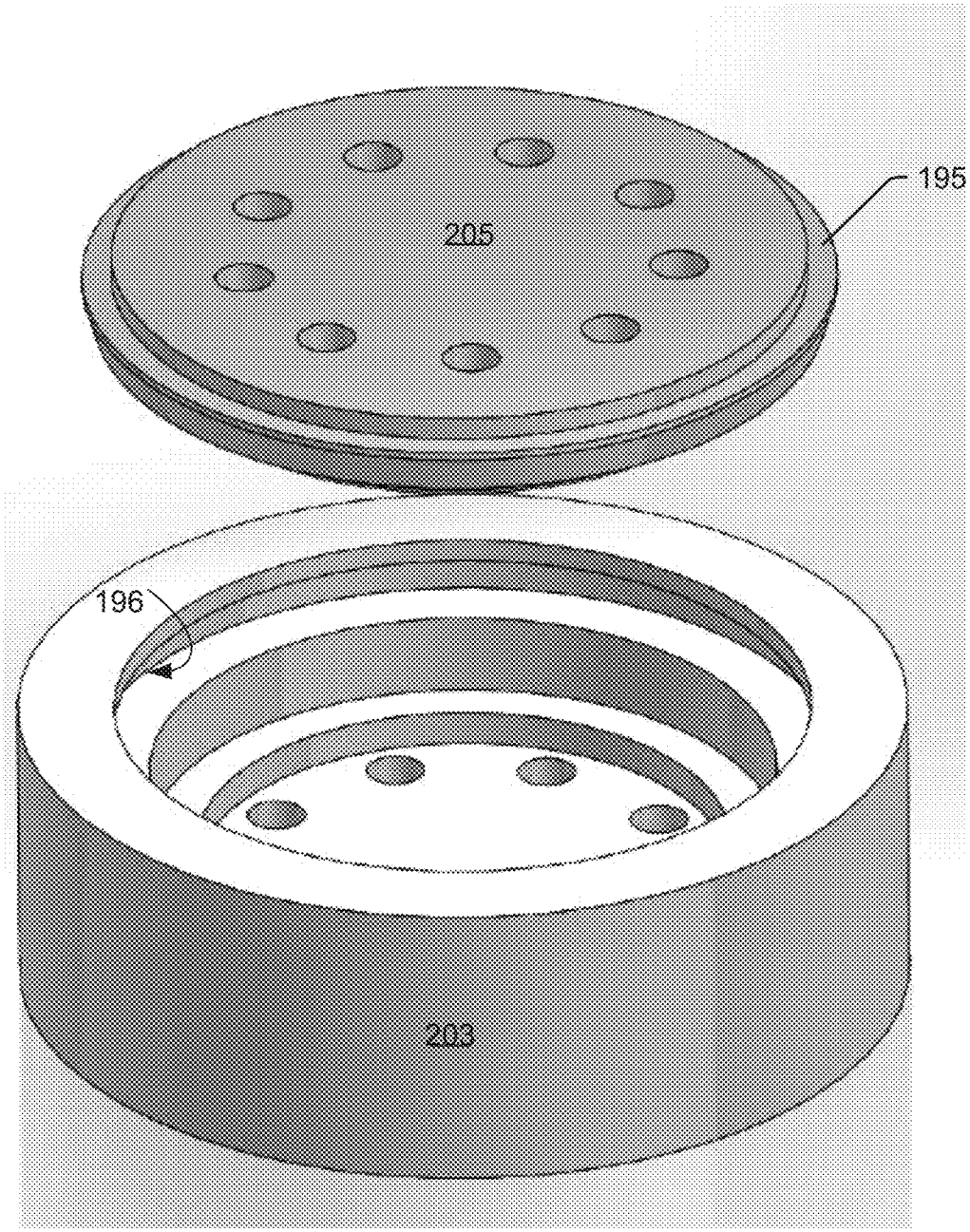
FIG. 34 illustrates an alternative configuration of subcomponents of a hockey puck according to a further embodiment of the present invention.
Figure 35:
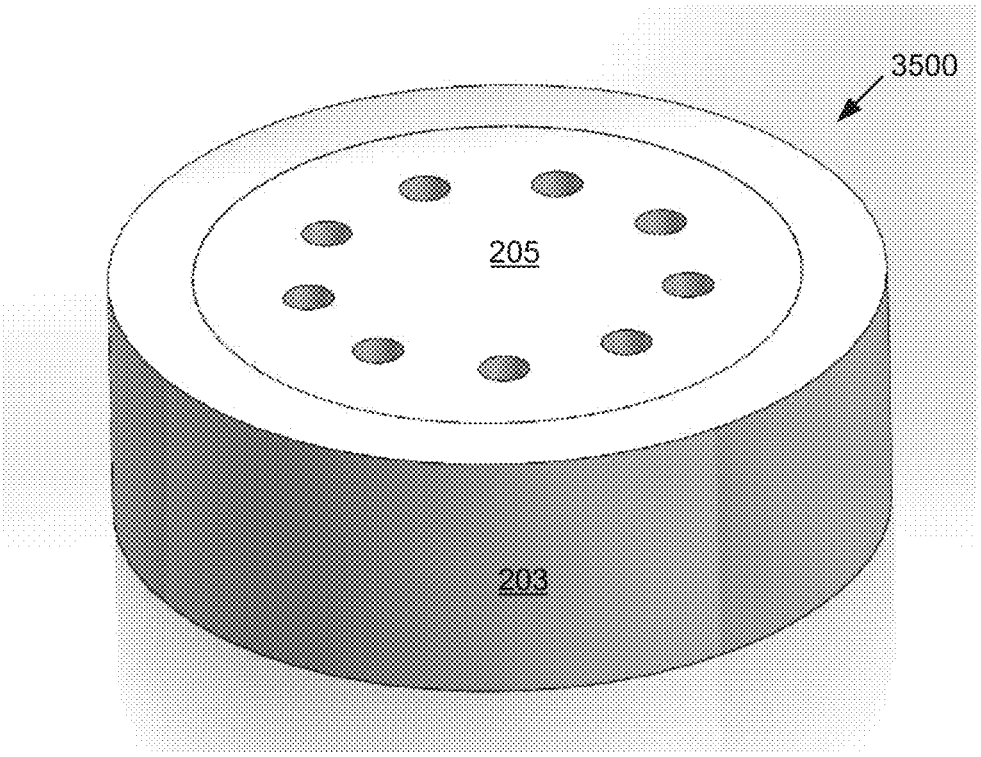
FIG. 35 illustrates an alternative configuration of subcomponents of a hockey puck according to a further embodiment of the present invention.
Figure 36:
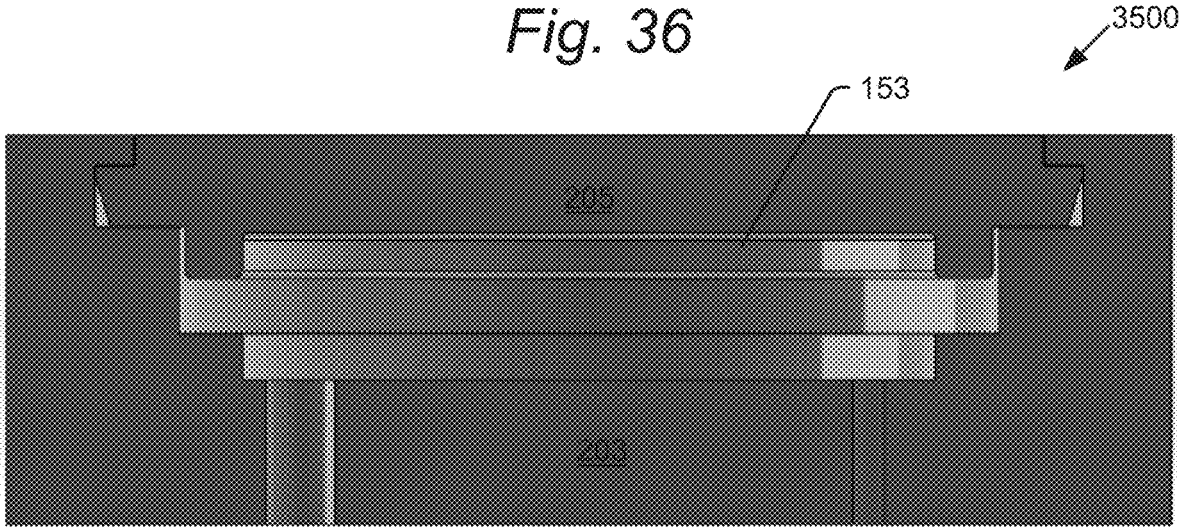
FIG. 36 illustrates an alternative configuration of subcomponents of a hockey puck according to a further embodiment of the present invention.

FIGS. 34-36 illustrate an embodiment of a subcomponent 205 including a lip 195 which snaps into an annular space 196 in the subcomponent 203 upon mating of the subcomponents 203, 205 in puck 3500.

Figure 38:
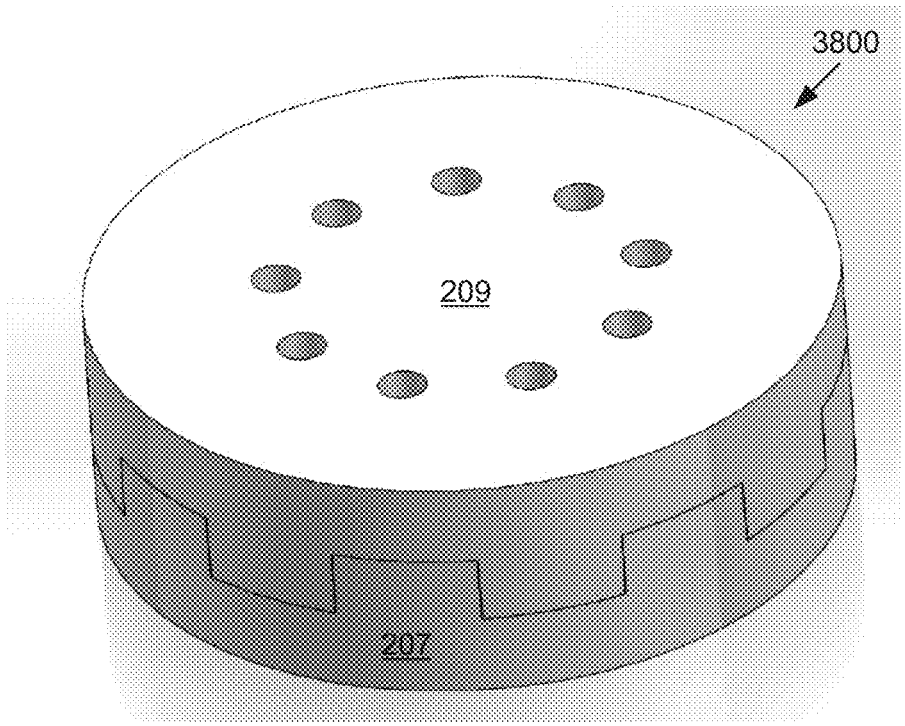
FIG. 38 illustrates an alternative configuration of subcomponents of a hockey puck according to a further embodiment of the present invention.
Figure 39:
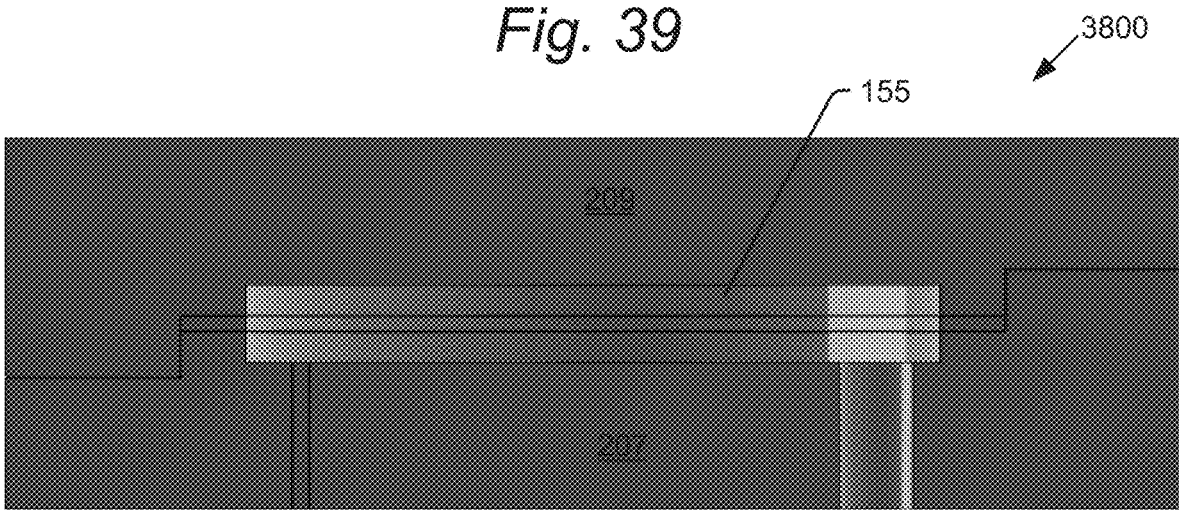
FIG. 39 illustrates an alternative configuration of subcomponents of a hockey puck according to a further embodiment of the present invention.

FIGS. 37-39 illustrate an embodiment of subcomponents 207, 209 forming a seam around the circumferential edge of the hockey puck 3800. In this embodiment, the upper subcomponent 209 is formed with downwardly-extending saw-tooth protrusions defined by vertical edges.

These protrusions mate with upwardly-extending saw-tooth protrusions in the lower subcomponent 207 to form interleaved finger joints that make full surface contact between adjacent protrusions. The protrusions are tapered so that the edges that contact adjacent protrusions align along a radius of the puck, such that each protrusion is wider towards an exterior of the first and second subcomponents and narrower towards an interior of the first and second subcomponents, and wherein an interior end of each protrusion is curved.

Figure 40:
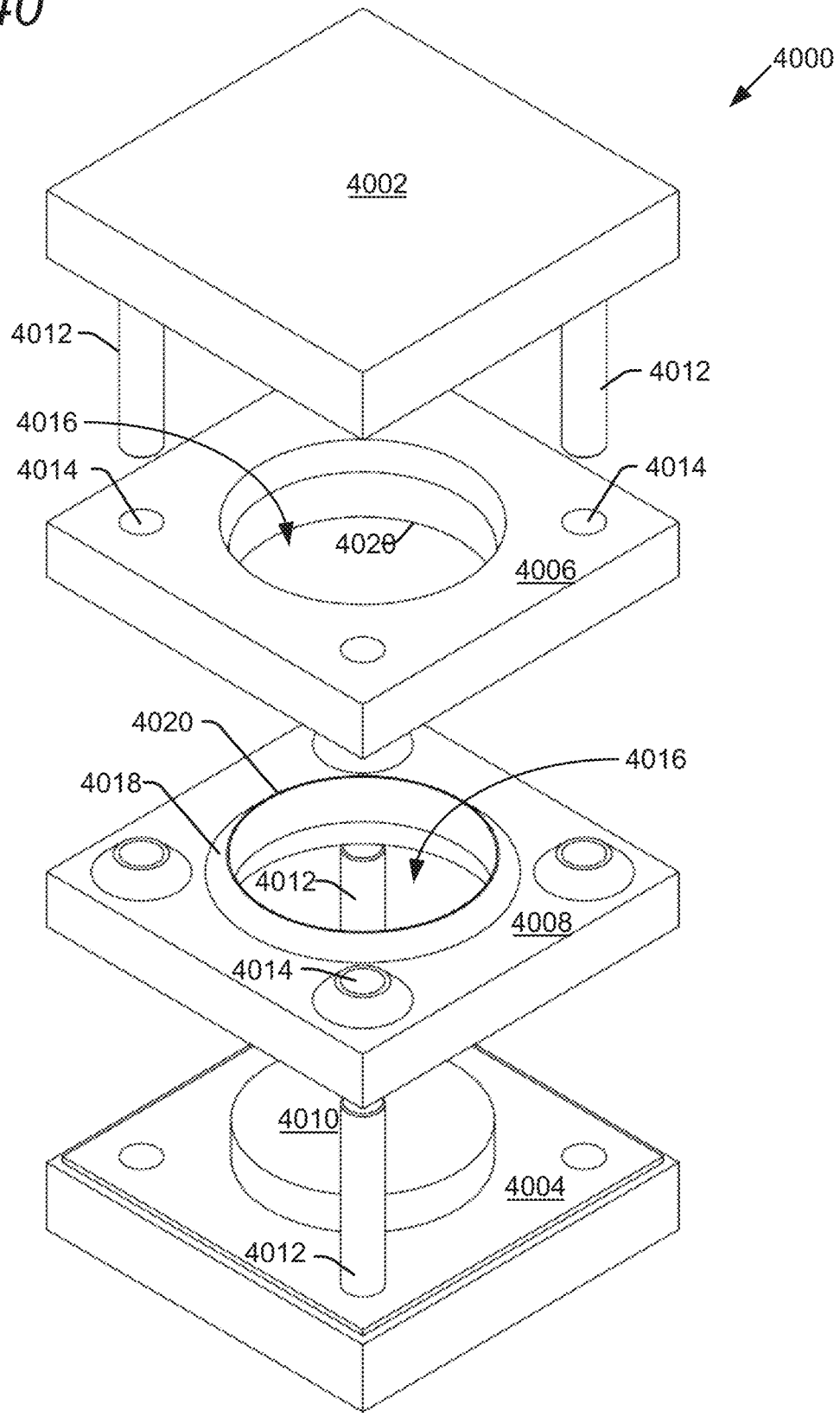
FIG. 40 is an exploded perspective view of a mold including mold plates and fixtures for use in gluing together subcomponents of the hockey puck according to an embodiment of the present invention.
Figure 42:
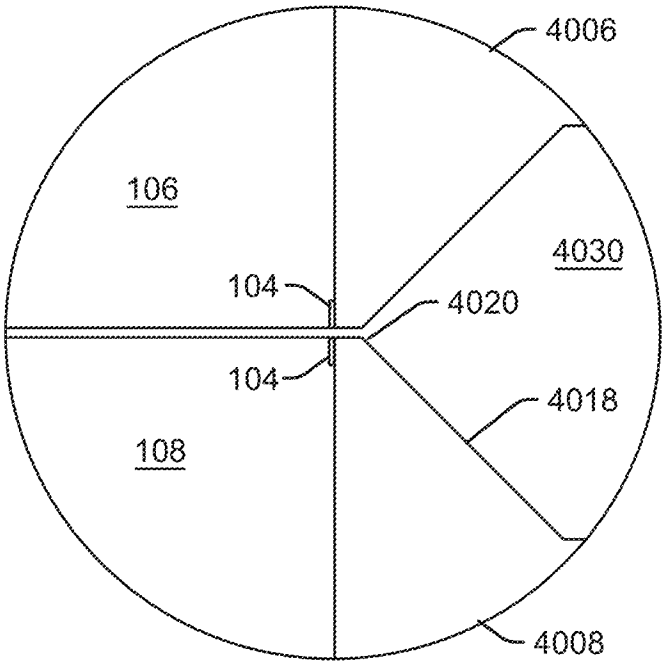
FIG. 42 is an enlarged view of area C from FIG. 41.
Figure 41:
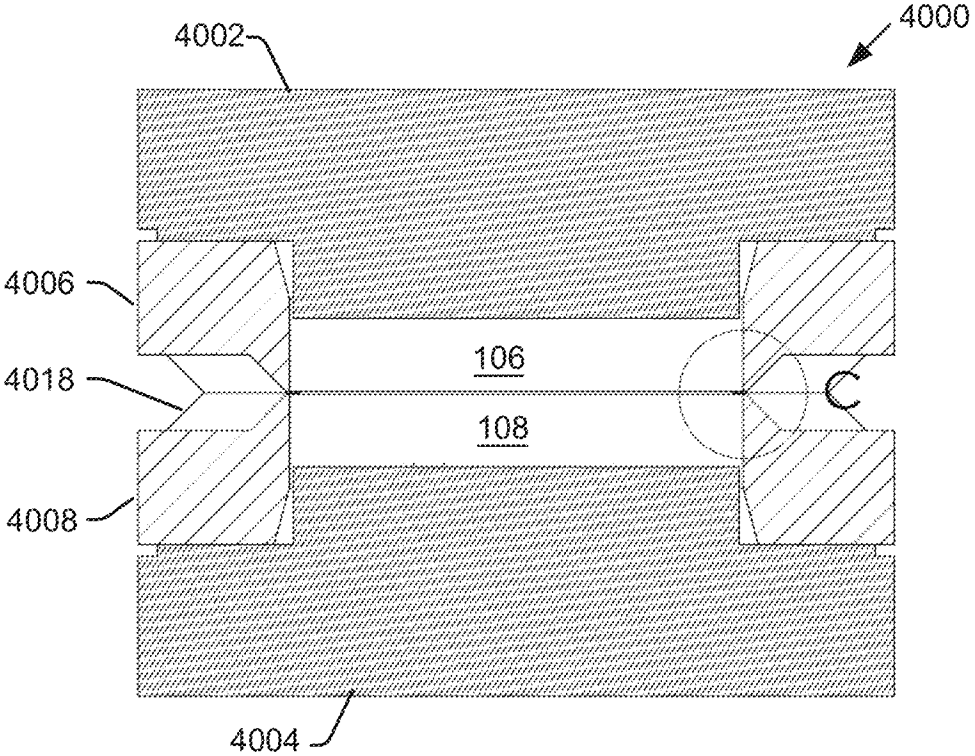
FIG. 41 is a cross-sectional view of the mold of FIG. 40 gluing together subcomponents of a hockey puck according to embodiments of the present invention.

FIGS. 40-42 illustrate a press 4000 for use in gluing together the subcomponents of the various embodiments shown in the figures. Press 4000 may include a top plate 4002 and a bottom plate 4004. Press 4000 may further include top fixture 4006 and bottom fixture 4008. The plates and fixtures of press 4000 may for example be formed of stainless steel.

In operation, a subcomponent, such as for example subcomponent 108, may be placed on a platform 4010 on the bottom plate 4004. The fixture 4008 may then be fit down over the bottom plate 4004 so that adjacent surfaces of the fixture 4008 and bottom plate 4004 lie contact with each other. The bottom plate 4004 may include a pair of upwardly extending guideposts 4012 received within guide holes 4014 in fixture 4008 to ensure precise alignment of the fixture 4008 on top of the bottom plate 4004.

The fixture 4008 includes a central opening 4016 which fits down over platform 4010. The central opening has a raised surface 4018 so that a height of the cylindrical walls of opening 4016 are equal to the height of the platform 4010 plus the height of the subcomponent 108 on top of platform 4010. An uppermost circular portion of the cylindrical walls of opening 4016 (where the raised surface 4018 meets the cylindrical walls) defines a lip 4020.

The top plate 4002 and top fixture 4006 have the same configurations and structures as lower plate 4004 and bottom fixture 4008, as indicated for example by those components which are numbered on top plate 4002 and top fixture 4006. The top plate and fixture 4002, 4006 may be turned upside down, and the second subcomponent, for example subcomponent 106, may then be placed on a platform 4010. The top fixture 4006 may then be fit over top plate 4002 to secure the subcomponent 106 in place as described above with respect to the bottom plate and fixture.

An adhesive material may then be applied to the features 130 (described above) on the interior surface(s) of subcomponent 106 and/or 108. The top plate 4002, top fixture 4006 and subcomponent 106 may then be flipped and fit on top of bottom plate 4004, bottom fixture 4008 and subcomponent 108. The guideposts 4012 in top plate 4002 fit through the guide holes in bottom fixture 4008. Similarly, the guideposts 4012 in bottom plate 4004 fit into guide holes 4014 in the top fixture 4006. This ensures proper alignment of all components in the press 4000, and proper alignment of the subcomponents 106 and 108 with respect to each other.

Thereafter, large compressive forces may be applied to the top and bottom plates 4002, 4004 by a hydraulic device (not shown) to press the features 130 on the interior surfaces of subcomponents 106, 108 against each other. The adhesive may then be cured under pressure for a period of time, and possibly at an elevated temperature. The adhesive may form a mechanical or chemical bond to seal the subcomponents 106, 108 together. The pressure may squeeze out any excess adhesive from between the subcomponents 106 and 108. The press 4000 may be heated during the gluing process to reduce the hydrostatic pressure generated by the glue as it is forced out from between the subcomponents 106, 108.

FIG. 41 is a cross-sectional view of the components of press 4000 sealing subcomponents 106 and 108 together. FIG. 42 is an enlarged sectional view of the area C of FIG. 41. As shown in FIGS. 41 and 42, when the bottom fixture 4008 is seated on top of bottom platform 4004, around subcomponent 108, the lip 4020 aligns snugly against the seam 104 in a top portion of the outer circumferential edge of subcomponent 108. Similarly, when the top fixture 4006 is seated on over of top plate 4002, around subcomponent 106, the lip 4020 aligns snugly against the seam 104 around a lower edge portion of the outer circumferential edge of subcomponent 106.

The tight engagement of the lip 4020 against the seam 104 in the subcomponents 106 and 108 ensures that, as glue is squeezed out from between subcomponents 106 and 108, the excess glue enters a space 4030 defined between the top and bottom fixtures 4006, 4008. Significantly, the tight engagement of the lip 4020 against the seam 104 prevents any excess glue from passing between the respective subcomponents and fixtures, onto the outer circumferential edge of the subcomponent 106 and/or 108. As discussed above, the outer circumferential edge of the hockey puck 100 may include a dimple pattern. The tight engagement of the lip 4020 against the seam 104 prevents adhesive from bleeding onto the dimple pattern.

Turning now to the fabrication of the subcomponents of hockey puck 100, the subcomponents may be formed of vulcanized rubber, for example containing natural rubber, oils for durability, minerals for curing and anti-aging agents, and coal dust (carbon black) for color. The various materials of the subcomponents may be thoroughly mixed together in predefined ratios, and then placed in a mold under pressure of a hydraulic press and cured, for example at 300° F. to 500° F. for 15 to 20 minutes. These temperatures and times are by way of example only, the curing temperatures and times may be lower or higher than the stated ranges in further embodiments.

The materials and ratios are controlled to provide the puck 100 with the same characteristics and properties as a conventional puck not having a signal transmitter core. For example, the signal transmitter in the hollow core tends to increase the amount by which the puck bounces off a surface as compared to a conventional puck. Thus, the materials and/or ratios may be controlled to be relatively energy absorbing so as to deaden the response of the subcomponents in comparison to the vulcanized rubber used in a conventional puck. In this way, the response of puck 100 including the signal transmitter core is the same as a conventional puck. It is understood that the materials and/or ratios may be varied, depending on whether the signal transmitter 110 is encased within a capsule 144 or sealed within the puck 100 without a capsule 144.

The subcomponents may be made in two pieces, and then glued around the signal transmitter 110 (as the signal transmitter may not withstand the curing conditions for the subcomponents if a single subcomponent were molded around the signal transmitter). However, in further embodiments, it is contemplated that the vulcanized rubber be molded in a single piece around the signal transmitter. In such embodiments, the signal transmitter may be encased in a capsule as described above, or not encased in a capsule as described above. The press 4000 may form a single puck 100. Alternatively, the press may be elongated (or made into an x-y matrix) including multiple central openings 4016 and other components described above for receiving multiple pairs of subcomponents 106, 108, so that multiple pucks 100 may be formed in a single process.

In embodiments described above, the subcomponents include openings so that the electromagnetic radiation from the diodes may be transmitted through the subcomponents to an exterior of the puck 100. In embodiments, the vulcanized rubber of the subcomponents may include carbon black, which prevents the transmission of certain wavelengths of electromagnetic radiation, such as for example radiation in the IR wavelengths.

In further embodiments of the present technology, the puck may be formed of materials that are transparent to the wavelengths of the electromagnetic radiation emitted from the signal transmitter 157. In such embodiments, the axial openings and radial channels in the subcomponents may be omitted, and the electromagnetic radiation may be transmitted through the walls of the subcomponents. Such an embodiment is shown in the perspective view of FIG. 43.

Figure 43:
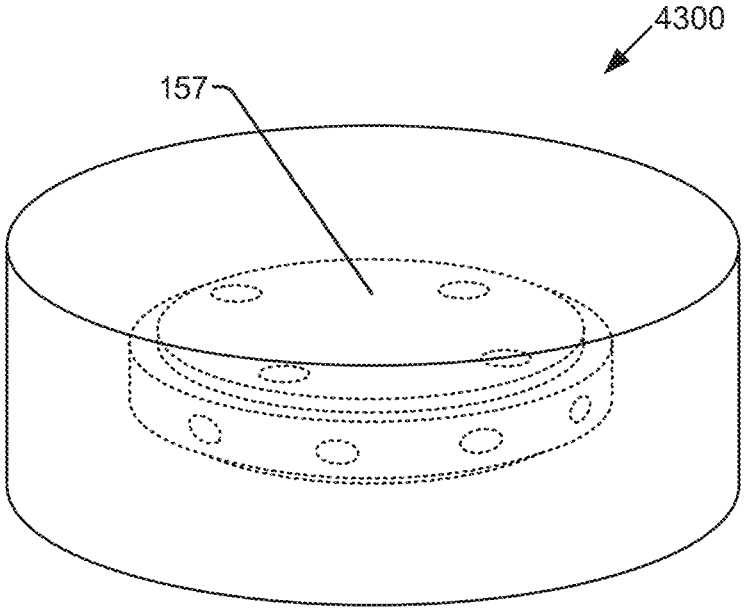
FIG. 43 is a perspective view of a puck according to a further embodiment of the present invention.

FIG. 43 shows a signal transmitter 157 encased within the interior of a puck 4300. The signal transmitter 157 may be as described above, and may or may not be encased within capsule. The puck 4300 of FIG. 43 may have the same color and other properties of a conventional hockey puck, but may for example be colored black without the use of carbon black. Other black-pigmented materials, such as for example powdered ash or other powdered materials, may be used in the vulcanized rubber to give the puck 4300 its black color. Without carbon black, the electromagnetic radiation from signal transmitter 157 may radiate from the puck 4300 without having to provide openings in the puck.

It is further conceivable that the signal transmitter transmits at wavelengths that are not blocked or absorbed by carbon black. In such embodiments, the vulcanized rubber of puck 100 may include carbon black.

Figure 44:
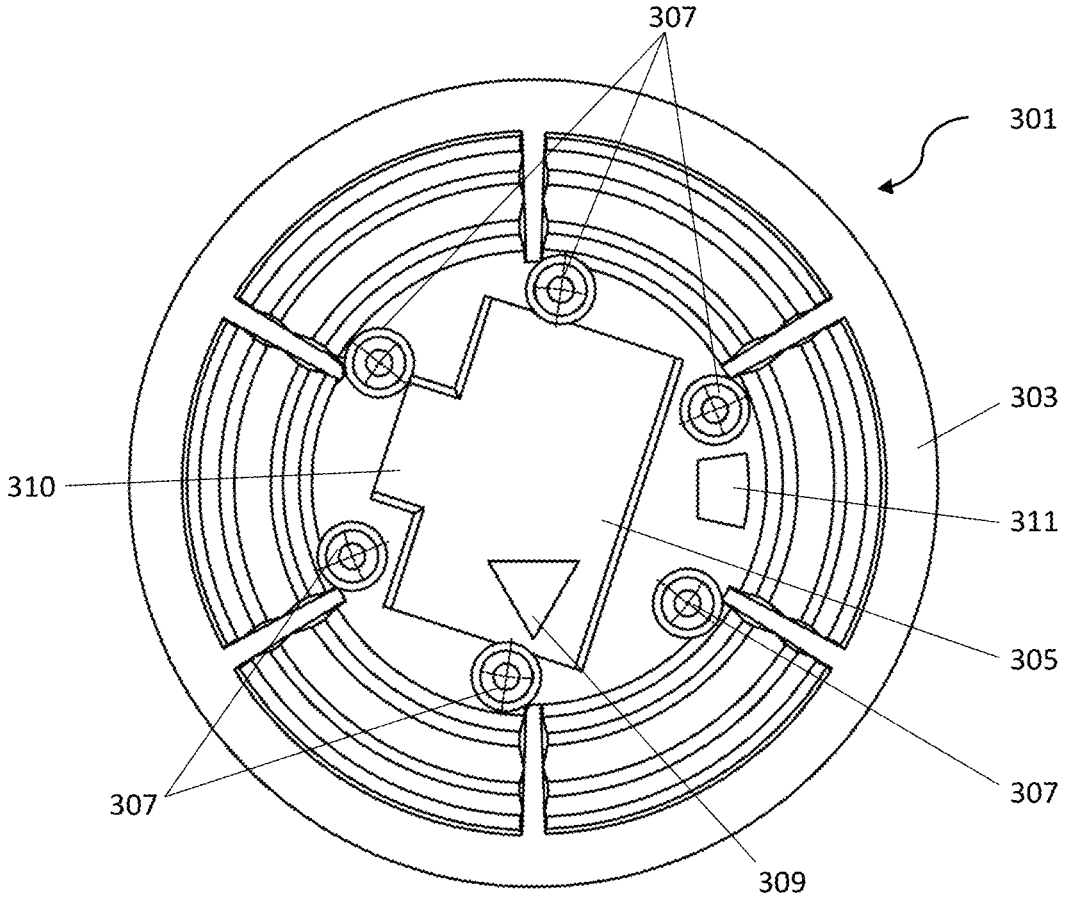
FIG. 44 illustrates a top view of a subcomponent of a hockey puck with concentric keyed features, according to one embodiment of the present invention.

FIGS. 44-49 demonstrate a preferred embodiment of the present invention. In manufacturing, it is generally desirable to have a minimal number of unique parts. Therefore, in a preferred embodiment, the same piece, subcomponent 301, is operable to be used for both halves of the puck. FIG. 44 illustrates an interior surface 303 of subcomponent 301 for receiving and supporting the signal transmitter 110. It is understood that two identical subcomponents 301 are used at a time to receive and support the signal transmitter 110. Interior surface 303 is not visible after the subcomponents are sealed together.

As seen in FIG. 44, the interior surface 303 of subcomponent 301 includes a cavity 305 sized and shaped to receive the power source 112 on a surface of the PCB 114. The cavity 305 further includes a sensor slot 310, which is operable to receive a sensor component of the signal processor 110. The interior surface 303 of the subcomponent 303 further includes holes 307 for receiving the extending diodes on the top or bottom surface of the PCB 114. In one embodiment, the holes 307 continue through the entire body of the subcomponent 301. The interior surface 303 also includes an antenna depression 311, which is operable to receive an antenna component of the signal transmitter 110. The cavity 305 further includes an interior indicator marking 309, which is beneficial in aligning the two halves of the hockey puck during assembly of the hockey puck, as each subcomponent 301 used is identical. In one embodiment, the interior indicator marking 309 is an arrow or a triangle, but it is understood that the interior indicator marking 309 could take the form of any useful marking or indicia. With the exception of the holes 307, no other indentations or cavities formed on the interior surface 303 of the subcomponent 301 are open to an exterior of the hockey puck, in one embodiment of the present invention.

Figure 46A:
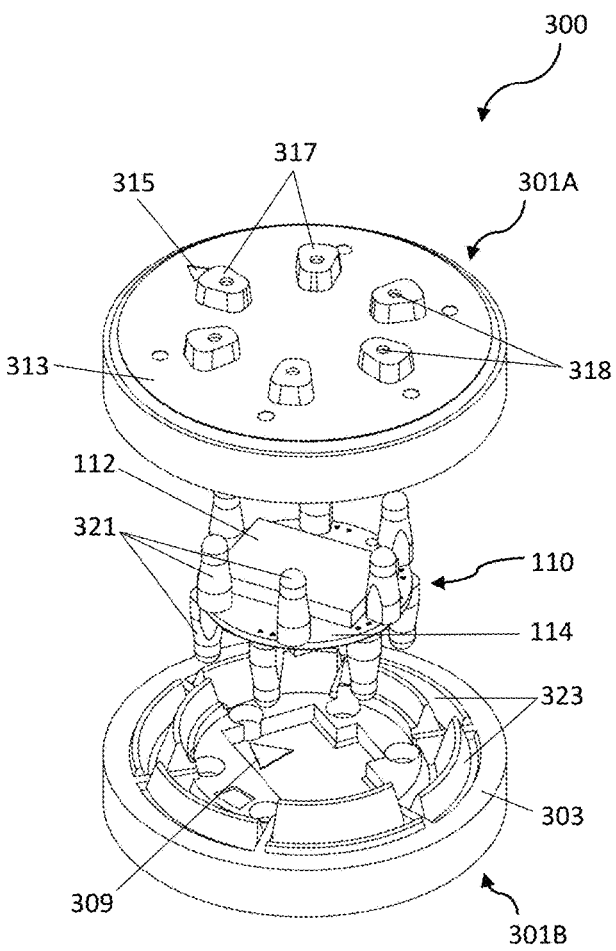
FIG. 46A illustrates an exploded perspective view of one embodiment of a hockey puck with alternating concentric keyed features, according to the present invention.
Figure 46B:
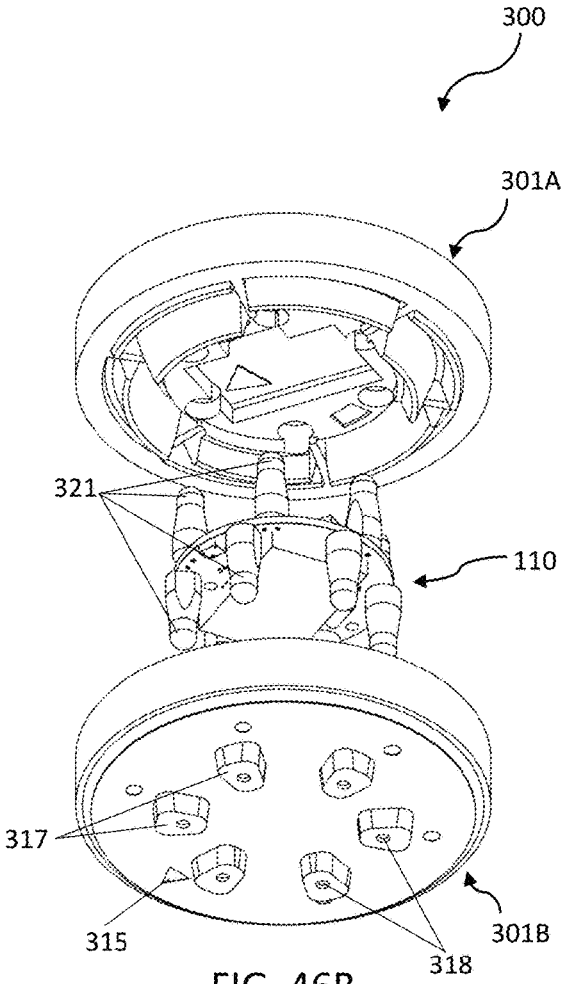
FIG. 46B illustrates an exploded perspective view of one embodiment of a hockey puck with indicator markings, according to the present invention.

FIG. 45A illustrates the exterior surface 313 of subcomponent 301. While the final product of a hockey puck, once processed, has a flat exterior surface, in one embodiment, the exterior surface 313 further includes raised diode housings 317 (two of which are numbered here). If holes 307 go through the whole body of subcomponent 301, raised diode housings 317 include vent holes 318 (two of which are labeled) at the opposite end of holes 307. Raised diode housings 317 are operable to be produced during the manufacturing step by molding, and then removed during final processing of the puck 300, as taught below. Further illustrated is an exterior indicator marking 315. Similar to interior indicator marking 309, exterior indicator marking 315 is beneficial in aligning the two halves of the hockey puck during assembly. Exterior indicator marking 315 is further operable to be removed during production of the hockey puck, which in one embodiment occurs by surface grinding, after the two subcomponents 301 have been permanently joined. The raised diode housings 317 are visible in FIG. 45B, a cross-sectional view of subcomponent 301. The raised diode housings create space for holes 307, which are operable to receive a diode or other component of signal processor 110. FIG. 45C is an enlarged sectional view of area D of FIG. 45B, and further illustrates both exterior indicator 315 and removable area 316. Removable area 316 is a thin layer of material on exterior surface 313 operable to be removed during production of the hockey puck, which in one embodiment occurs by surface grinding, after the two subcomponents 301 have been permanently joined. FIGS. 46A and 46B illustrate exploded views of a preferred embodiment of a hockey puck 300. The hockey puck 300 includes a top and bottom subcomponent, wherein both the top and bottom subcomponent are the same subcomponent illustrated in FIGS. 44-45C. The hockey puck 300 further includes a signal transmitter 110 housed between the two halves. Diodes 321 (three of which are marked) and a power source 112 are visible on the signal transmitter 110. Each of the subcomponents 301A, 301B includes an exterior surface 313, which is visible when the subcomponents 301A, 301B are sealed together to form the finished puck, and an interior surface 303, which is not visible after the subcomponents are sealed together. FIGS. 46A and 46B show perspective views of the external surfaces 313 of the subcomponents 301A and 301B, according to the preferred embodiment, such that an exterior indicator marking 315, raised diode housings 317, and vent holes 318 are visible. FIGS. 46A and 46B further show perspective views of the interior surfaces 303 of the subcomponents 301A, 301B, according to a preferred embodiment. As shown, the interior surface 303 of each subcomponent 301A, 301B includes keyed features 323 which ensure a tight and secure fit of the subcomponents when they are glued to each other. The keyed features 323 are operable to be arranged in a variety of different configurations, and in a preferred embodiment the keys include a plurality of wedges and valleys which are a variety of heights and are placed at a variety of distances from the center of subcomponent 301A, 301B, but are all concentric. The keyed features 323 are placed and sized such that one subcomponent 301A is able to mate with another subcomponent 301B, wherein the wedges and valleys of wedges of keyed features 323 align. Thus, the interior surface 303 of one subcomponent 301A is operable to mate snugly with the interior surface 303 of a second subcomponent 301B. Interior indicator marking 309 is useful in properly orienting the subcomponents 301A, 301B to allow this mating to occur. Like the interior features of the embodiment illustrated by FIGS. 7 and 8, the keyed features 323 increase the surface area for securely gluing the subcomponents 301A and 301B together and provide a resistance to shear forces when the subcomponents 301A and 301B are affixed together and thereafter. In one embodiment, the wedges of the keyed features 323 are positioned at non-uniform distances from a center of the subcomponent 301A, 301B. In another embodiment, each wedge of the keyed features 323 is curved such that it is concentric with the puck, wherein each of the wedges of the keyed features 323 are concentric but are not all equiradial. For example, in one embodiment, a first set of three wedges have the same radius and three additional concentric wedges are positioned closer to a center of the puck with a radius that is less than that of the first set of three wedges. In another embodiment, the wedges and valleys of the keyed features 323 are concentric and co-radial, but they are laid out in multiple rows surrounding a center of the puck. In one embodiment, there are three concentric rows around a center of the puck, and each row contains three valleys and three ridges in an alternating and discontinuous pattern. For example, in FIG. 48A, the puck includes six subsets of wedges 351, wherein each subset has three rows (353, 355, 357), wherein each row within a set alternates between a peak and a valley, and wherein rows alternate in a pattern between a peak and a valley in adjacent sets. In the illustrated embodiment, an outermost row 353 of the first set of wedges starts with a peak, wherein a middle row 355 is a valley, and wherein an inner row 357 is a peak. Preferably, a space and/or a channel separates the between the end of one set of wedges and the beginning of the next. In one embodiment, the puck is constructed with six subsets of rows with three rows for each subset. In another embodiment, the puck is constructed with at least two row subsets of at least one row for each subset. In another embodiment, the puck is constructed with between 1 and 10 subsets with between 1 and 5 rows for each subset. Notably, a further embodiment, the puck includes any range of subsets between 1 and 10 and any rows between 1 and 5.

Figure 47A:
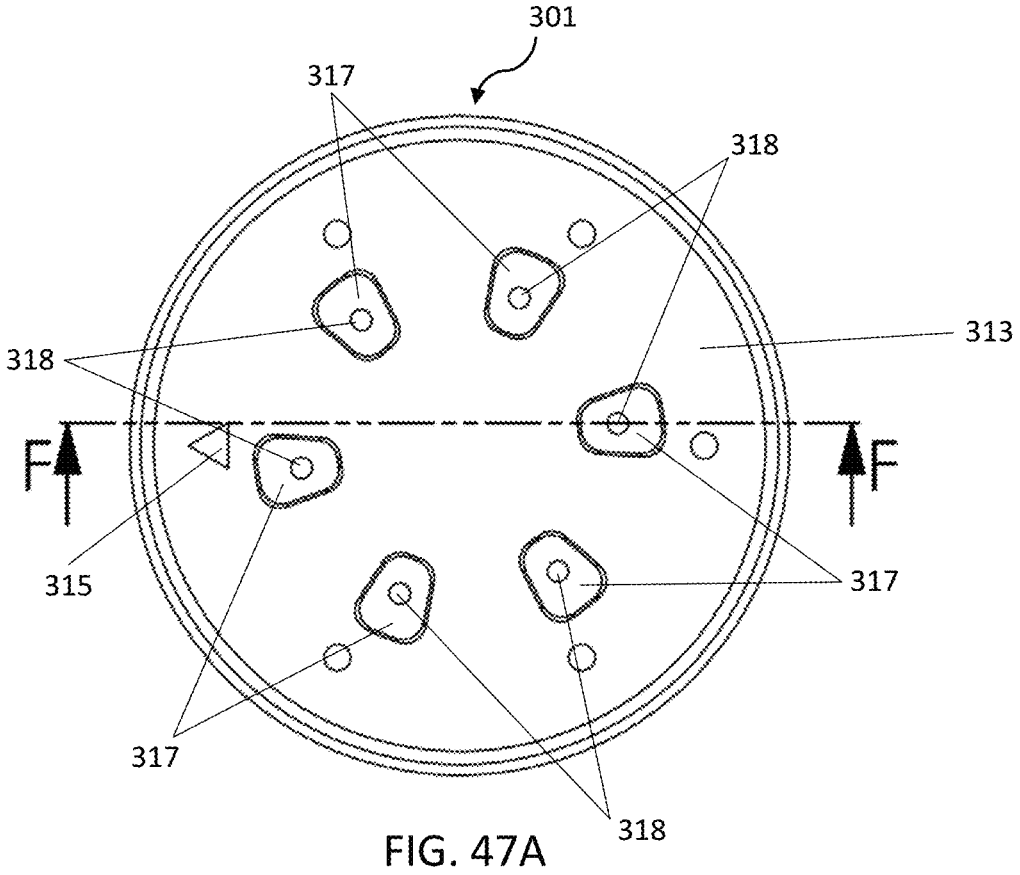
FIG. 47A illustrates a top view of a subcomponent of a hockey puck with an indicator marking, according to one embodiment of the present invention.
Figure 47B:
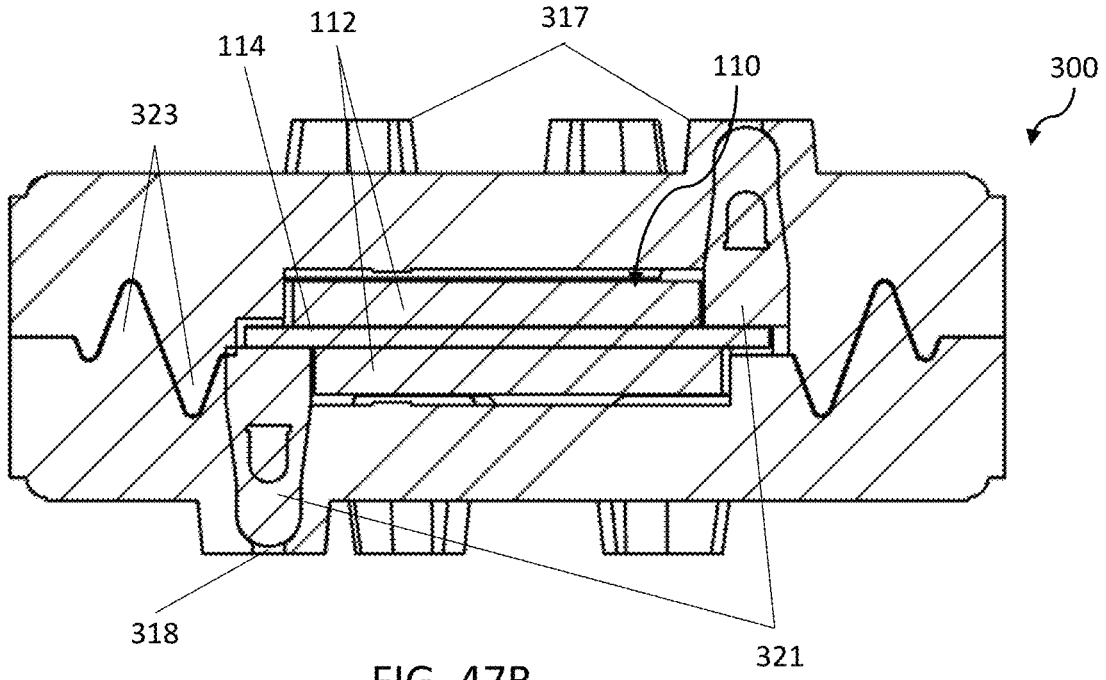
FIG. 47B is a cross-section view through line F-F of FIG. 47A.

FIG. 47A shows a top view of a puck 301, specifically the exterior surface 313 of the embodiment illustrated by FIG. 45A, including raised diode housings 317 and vent holes 318. FIG. 47B is a cross-sectional view of the puck 300 according to the embodiment of FIG. 47A. As shown in the cross-section view of FIG. 47B, the concentric wedges and valleys of wedges of the keyed features 323 of each subcomponent 301 offset from the concentric wedges and valleys of wedges of the keyed features 323 of the other subcomponent 301. The subcomponents 301 line up to form a hockey puck 300 with no gaps. Also illustrated by this cross-section are the signal transmitter 110, including the PCB 114, diodes 321 mounted on the PCB, two power sources 312 mounted on the PCB 114, and the diodes 321 within holes 307. Vent holes 318 are also shown, wherein the by diodes 321 are positioned within the vent holes 318.

Figure 48A:
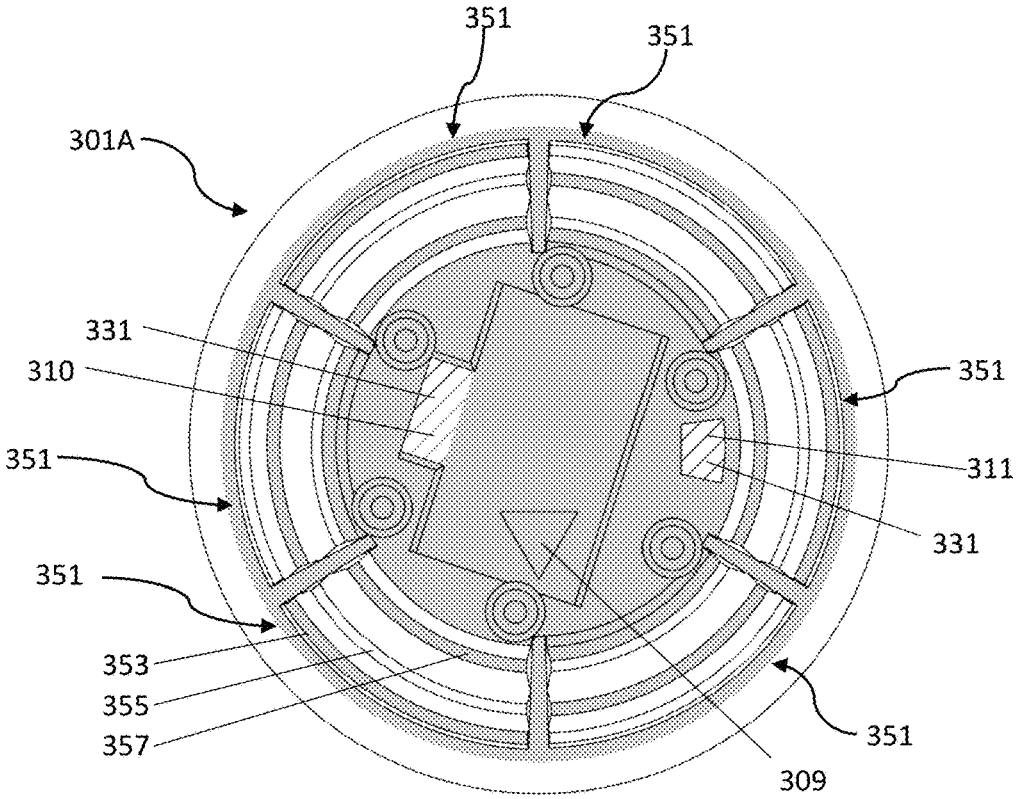
FIG. 48A illustrates a top view of a subcomponent of a hockey puck with sealant during the manufacturing process, according to one embodiment of the present invention.
Figure 48B:
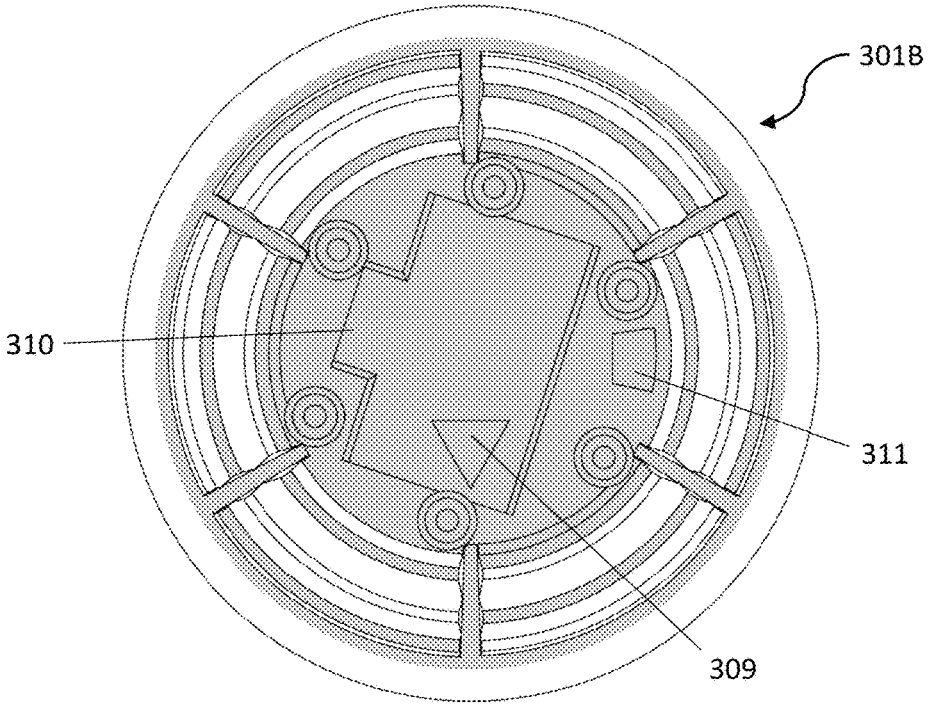
FIG. 48B illustrates a top view of a subcomponent of a hockey puck with adhesive during the manufacturing process, according to one embodiment of the present invention.

FIGS. 48A and 48B illustrate additional views of a hockey puck produced through the previously disclosed hockey puck assembly process. In a preferred embodiment, two identical subcomponents 301A and 301B are used to assemble the hockey puck. On one subcomponent 301A, the sensor slot 310 and antenna depression 311 are filled with sealant 331, while one second subcomponent 301B does not receive sealant, before gluing the subcomponents together. FIGS. 48A and 48B serve to differentiate between the subcomponents 301A and 301B with and without sealant. FIGS. 48A and 48B also illustrate all of the flat surfaces of the subcomponents 301A and 301B which receive glue during the puck assembly process, which are shaded in grey.

Figure 49A:
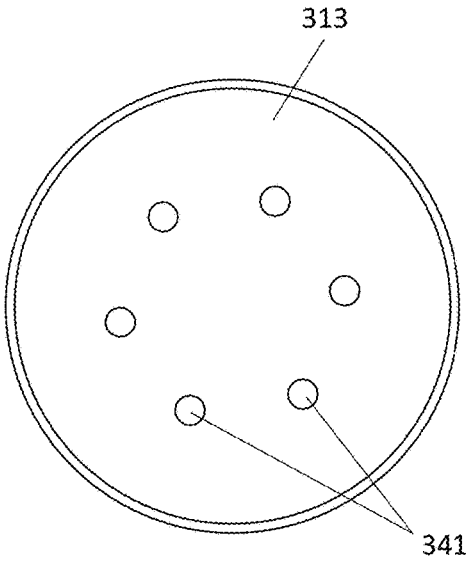
FIG. 49A illustrates a top view of a hockey puck with light pipes, according to one embodiment of the present invention.
Figure 49B:
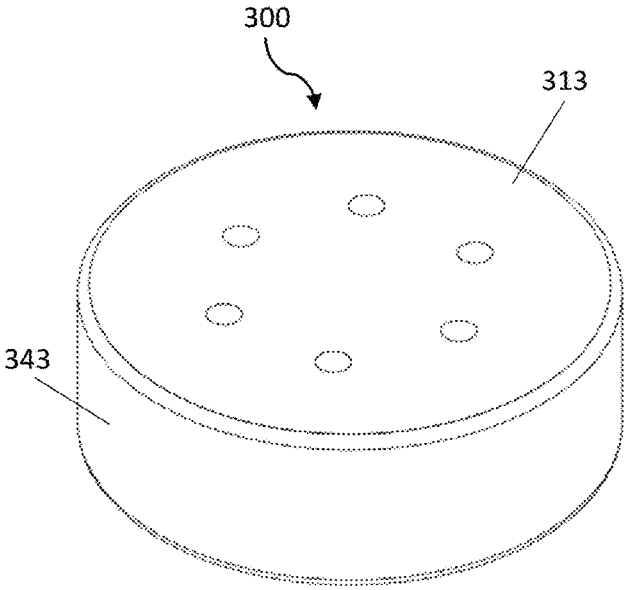
FIG. 49B illustrates a perspective view of a hockey puck with no exterior seam, according to one embodiment of the present invention.
Figure 49C:
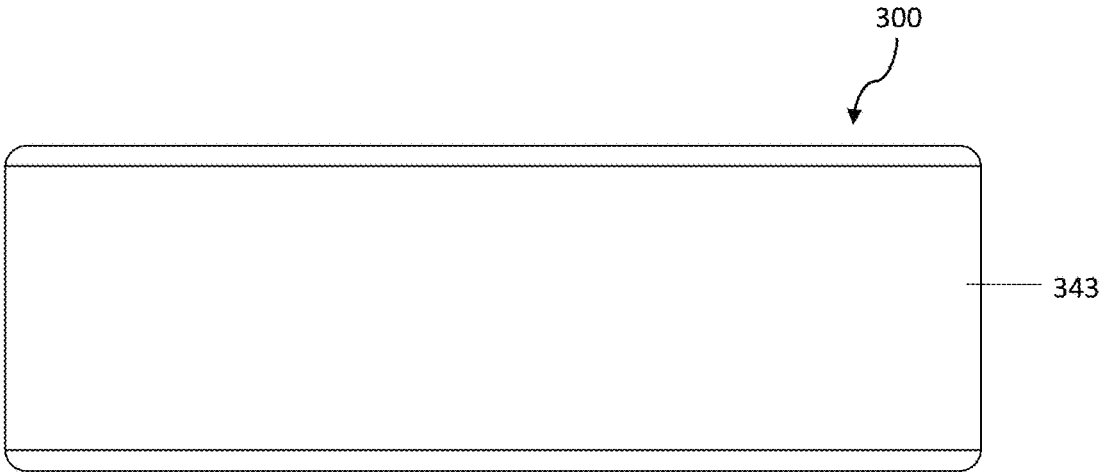
FIG. 49C illustrates a side view of a hockey puck with no exterior seam, according to one embodiment of the present invention.

FIGS. 49A-C illustrate a preferred embodiment of the present invention at the completion of the production process. The hockey puck 300 includes external surfaces 313 and vertical sides 343, which are perpendicular to each other. As discussed above, the outer vertical sides 343 are operable to include a dimple pattern or a knurling pattern. Furthermore, holes 341 expose and convey light emitted by diodes 321 mounted to the signal transmitter 110. Holes 341 are exposed when raised diode housings 317 are removed during the manufacturing of the puck 300. In one embodiment, the diodes 321 are flush with external surfaces 313. In another embodiment, glue is added during the production process which covers the ends of diodes 321 and is flush with external surfaces 313 after final processing of the puck 300. In another embodiment, after subcomponents 301 have been glued together and the surfaces of hockey puck 300 have been processed, there is no seam between the two subcomponents 301 that is visible with an unaided eye at 14 inches at standard office light levels, or at a distance of greater than 8 inches at standard office light levels. In one embodiment, standard office light levels are between about 150 lux and about 10,000 lux. In another embodiment, standard office light levels are between about 107 lux and about 107,527 lux.

Figure 50:
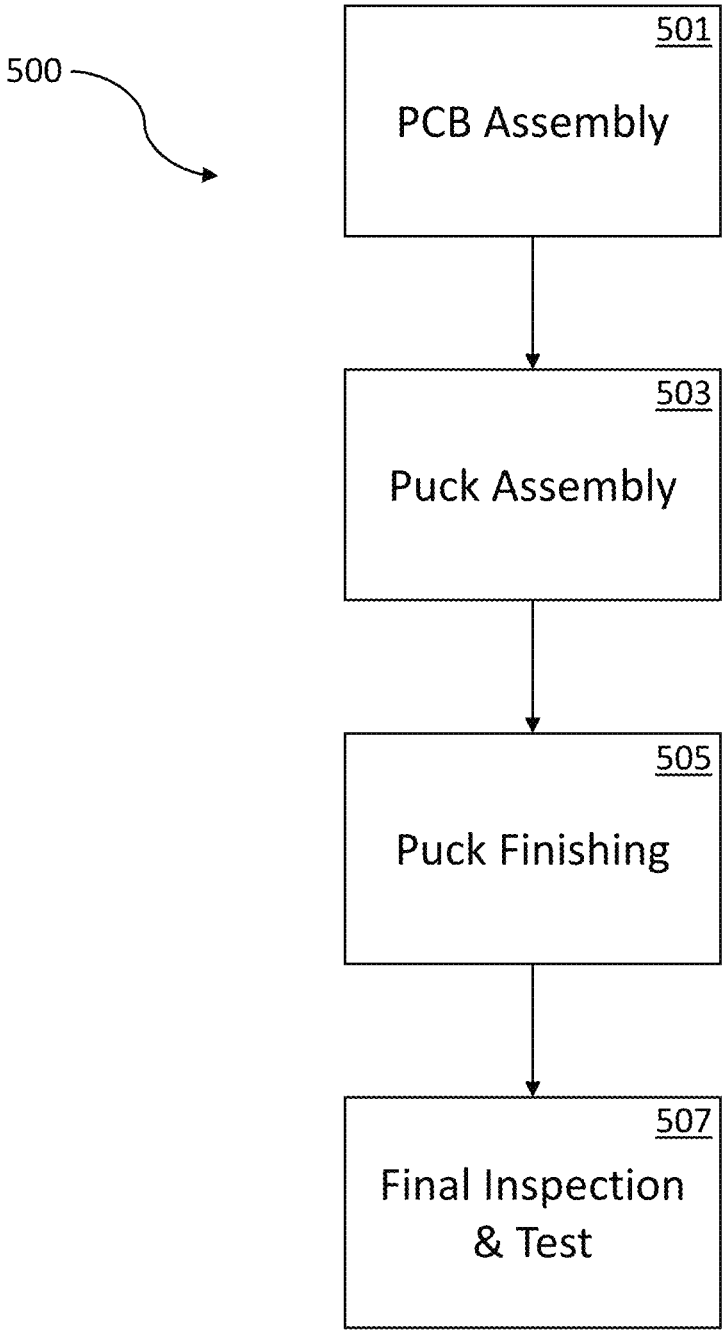
FIG. 50 illustrates a process for the production of a hockey puck, according to one embodiment of the present invention.

Further considering the process for manufacturing a hockey puck, FIG. 50 illustrates a process flow chart for the production of a hockey puck according to one embodiment of the present invention, which includes printed circuit board assembly 501, then puck assembly 503, then puck finishing 505, and then final inspection and testing 507. Each of these stages are described in more detail in FIGS. 51-53.

Figure 51:
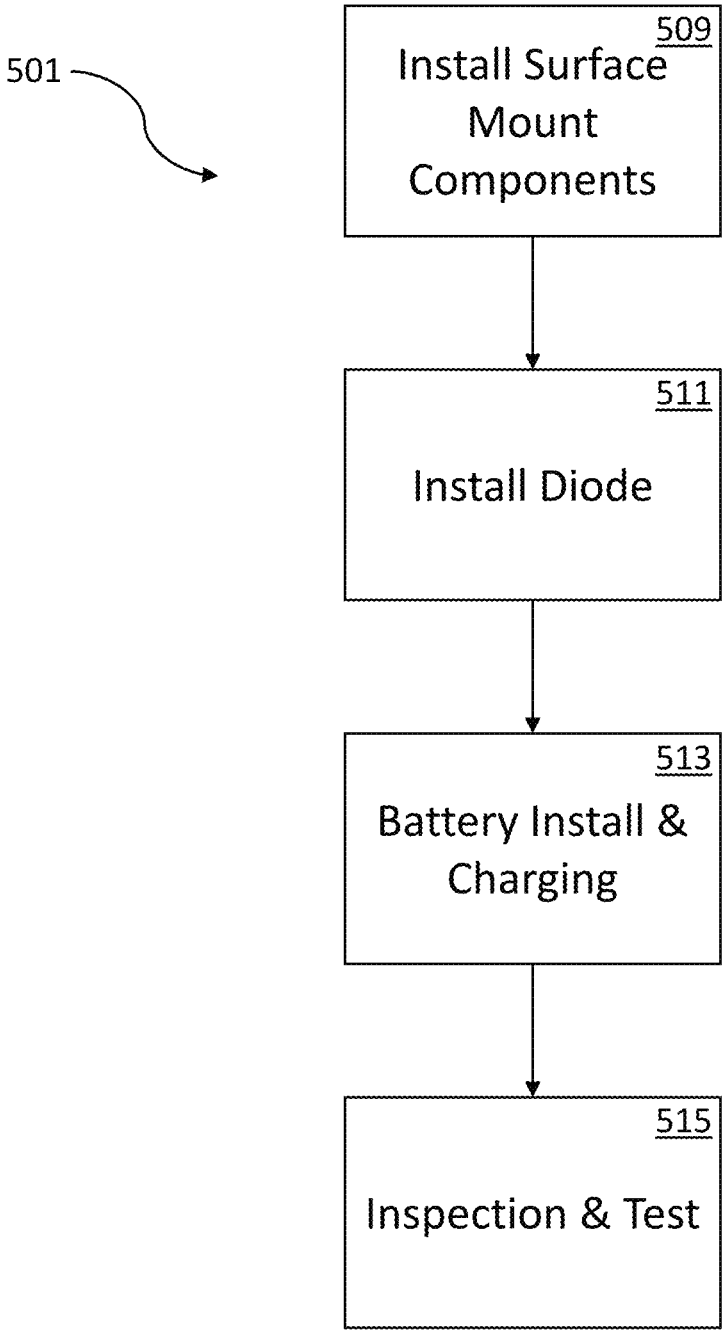
FIG. 51 illustrates a process for assembling electronic components of a hockey puck, according to one embodiment of the present invention.

FIG. 51 illustrates the process of printed circuit board assembly, referred to as signal transmitter 110, according to a preferred embodiment, which includes installing surface mounting components 509, diode install 511, installing and charging the battery 513, and an inspection and test 515. Details of the electronics and components of a signal transmitter 110 are disclosed, for example, in U.S. Pat. No. 5,564,698, entitled "Electromagnetic Transmitting Hockey Puck." Generally, the signal transmitter 110 includes a PCB 114 having driver electronics formed on top and bottom surfaces of the PCB 114 and a power source such as a rechargeable battery. In assembly of the signal transmitter 110, surface mount components, such as, but not limited to, a shock sensor are first installed. Then, the diodes 321, such as, but not limited to, surface mount LEDs or through-hole LEDs, are installed. On a first side of the PCB 114, the diodes 321 are operable to be automatically, selectively, or hand soldered. On a second side of the PCB 114, diodes 321 are operable to be automatically, selectively, or hand soldered. In a preferred embodiment, diodes 321 on a second side of the PCB 114 are hand soldered. In the preferred embodiment illustrated by FIGS. 46A and 46B, there are a total of twelve diodes 321: six axially extending diodes 321 on a first or top surface of PCB 114 and six axially extending diodes 321 on a second or bottom surface of PCB 114, such that a signal is operable to be emitted from both the top and bottom surfaces of the puck. It is understood that the signal transmitter 110 is operable to, in one embodiment, include six diodes 321 per subcomponent and 12 total diodes 321 (as illustrated in FIG. 46A). However, in another embodiment, the signal transmitter is constructed with any number of diodes 321, and diodes in other places than those shown. When the puck 300 is fully assembled, outer ends of the diodes 321 (i.e., most distal from the PCB 114) lie flush with the exterior surfaces 313 of the subcomponents 301. In another embodiment, the outer ends of the diodes 321 are covered by glue or any other adhesive, which is finished to lie flush with the exterior surfaces 313 of the subcomponents 301.

Subsequent from installation of diodes 321, one or more power source 112, such as a rechargeable battery, is installed onto the PCB 114. In one embodiment, the battery is one of: a lithium-ion battery, a nickel-metal-hydride battery, a nickel-cadmium battery, or a lead acid battery. In a preferred embodiment, two power sources 112 are installed. In a preferred embodiment, sealant is placed between the one or more power source 112 and the PCB 114 as the one or more power source is installed. In one embodiment, about 0.015 ounces of sealant is dispensed under each one or more power source 112. In another embodiment, between about 0.005 and about 0.05 ounces of sealant is dispensed under each one or more power source 112. In yet another embodiment, sealant is not dispensed until the sealant potting step of puck assembly. One or more power source 112 is then charged before testing. In one embodiment, the one or more power source 112 is charged on a bed of nails fixture for twenty minutes. Finally, it is ensured that the diodes 321 and remainder of electronics on the PCB 114 are functional and operating properly.

Figure 52:
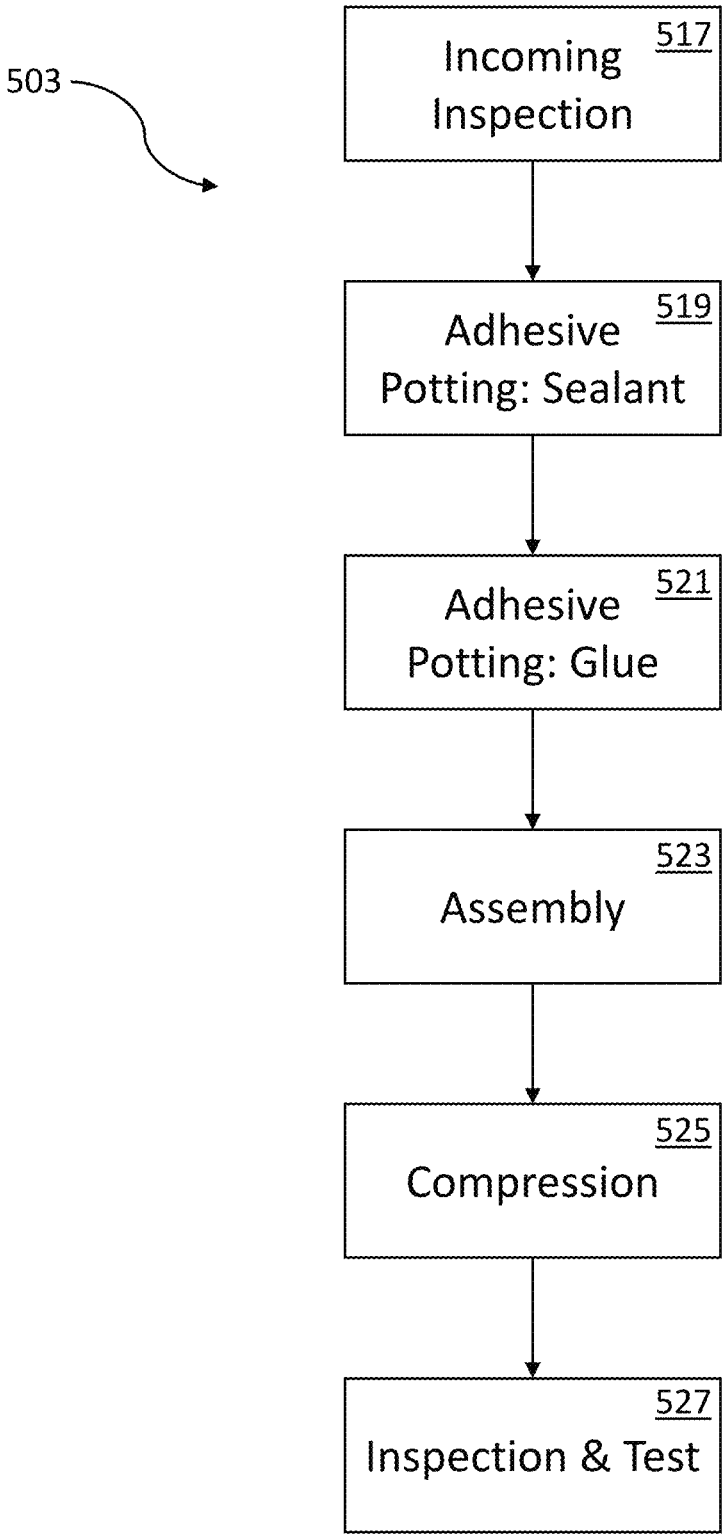
FIG. 52 illustrates a process for assembling components of a hockey puck, according to one embodiment of the present invention.

Assembling the components of a hockey puck according to a preferred embodiment requires a high degree of precision and includes multiple steps, which are illustrated in FIG. 52. First, the puck subcomponents are inspected 517, then adhesive potting of sealant takes place 519, followed by adhesive potting of glue 521, then parts are assembled 523 and compressed 525. The puck 300 then undergoes inspection and testing 527. In one embodiment, inspection of subcomponents 517 includes, but is not limited to, verifying the outside diameter, radius of outside diameter, thickness, weight, tactile feel, presence of incomplete fill or voids in the material, presence of excessive flash on the outside diameter edge, and uniformity of material color. In another embodiment, inspection also includes functional testing.

In the adhesive potting of sealant 519, puck assembly begins with two identical puck subcomponents 301 (puck halves). One subcomponent 301B is set aside, and a dose-controlled dispenser is used to apply sealant 331 in the sensor slot 310 and antenna depression 310 of the second subcomponent 301A. In one embodiment, about 0.009 ounces of sealant is dispensed into the subcomponent 301A. In another embodiment, between about 0.005 and about 0.05 ounces of sealant is dispensed into the subcomponent 301A. In one embodiment, if not previously completed during battery installation and charging 513, sealant is then dispensed under each one or more power source 112. In one embodiment, about 0.015 ounces of sealant is dispensed under each one or more power source 112. In another embodiment, between about 0.005 and about 0.05 ounces of sealant is dispensed under each one or more power source 112. In a preferred embodiment, the sealant is a modified sliane sealant such as TONSAN STP1921. In a preferred embodiment, tips such as 14 gauge 0.063 olive tips are used to dispense sealant. Throughout the sealant application process, gloves, acetone, and lint-free wipes are used as needed.

In the adhesive potting of glue 521, puck assembly continues with both identical puck subcomponents 301A and 301B. In one embodiment, all interior surface(s) and keyed features of subcomponents 301A and 301B are covered in glue, which is applied in one or more layers using an automated 3-axis dispensing system. In another embodiment, more than about 50% of the interior surface(s) and keyed features of subcomponents 301A and 301B are covered in glue. In yet another embodiment, more than about 25% of the interior surface(s) and keyed features of subcomponents 301A and 301B are covered in glue. In a preferred embodiment, there is one layer of glue applied. In an alternative embodiment, glue is applied by hand. In one embodiment, the approximate dispensing time of glue per subcomponent 301A and 301B is about 100 seconds. In another embodiment, the approximate dispensing time of glue per subcomponent 301 is between about 30 seconds and 180 seconds. This is accomplished with a bead of glue that is approximately 0.025 inches thick. Further, one or more layers of glue are dispensed in each hole 307, and in a preferred embodiment, three layers of glue are applied in each hole 307. In total, 0.102 ounces of glue are dispensed in the subcomponent 301B which did not receive sealant in the previous step, and 0.097 ounces of sealant are dispensed in the subcomponent 301A that did receive sealant in the previous step. In an alternative embodiment, between about 0.02 ounces and about 0.25 ounces of sealant are dispensed in the subcomponent 301B, and between about 0.02 ounces and about 0.25 ounces of sealant are dispensed in the subcomponent 301A. In a preferred embodiment, the adhesive is a cyanoacrylate adhesive such as CYBERBOND APOLLO 2240. In a preferred embodiment, tips such as polytetrafluoroethylene (PTFE) lined, pink, 0.5 inch by 0.012 inch tips are used to dispense the adhesive. Throughout the adhesive application process, gloves, acetone, and lint-free wipes are used as needed.

The parts of puck 300 are then assembled 523 prior to undergoing compression 325. Both subcomponents 301A and 301B are oriented such that the interior indicator marking 309 of each subcomponent 301A and 301B is pointing in a direction that indicates the keyed features are operable to line up. In one embodiment, each internal indicator marking 309 points directly towards the other internal indicator marking 309. In another embodiment, each internal indicator marking 309 is pointed directly away from the other internal indicator marking 309. In another embodiment, each internal indicator marking 309 points directly towards the other internal indicator marking 309, and then subcomponent 301A is rotated between 0 and 360 degrees counterclockwise, and subcomponent 301B is rotated by the same amount in the counterclockwise direction. Notably, each of the components are constructed such that valleys of a first subcomponent (301A) are aligned with peaks of a second subcomponent (301B) and peaks of the first subcomponent (301A) are aligned with valleys of a second subcomponent (301B), while the batteries, light pipes, and other elements are secured within the corresponding positions and cutouts. Thus, in one embodiment, the first subcomponent 301A and the second subcomponent 301B exhibit mirror and/or rotational symmetry when aligned. However, in one embodiment, the first subcomponent 301A is offset or rotated from the second subcomponent 301B to accommodate offset diodes and light pipes 321. The antenna of the signal processor 110 is then aligned with the antenna depression 310 on the subcomponent 301A which contains sealant 331. The signal processor 110, including diodes and power source, is pressed firmly into cavity 305 and holes 307 of the subcomponent 301A which includes sealant 331. Next, the interior surface 303 of both subcomponents 301A and 301B are aligned facing each other. Then, the exterior indicator markings 315 on both subcomponents are aligned such that they point in or indicate the same direction. Puck subcomponents 301 are then lightly pressed together. In one embodiment, an about 0.125 inch gap is left between puck halves. In one embodiment, the gap left between puck halves is larger than about 0.125 inches. In another embodiment, the gap left between puck halves is smaller than about 0.125 inches.

A press, such as the one illustrated by FIGS. 40-42, is then be used for compressing subcomponents 301 together. In another embodiment, the press is a donut compression fixture. To compress the assembly, the external surface 313 of each subcomponent 301 is covered with a donut fixture. The assembly, including the donut plates, are then placed in the compression fixture and a cover plate is placed on top. In one embodiment, a compressive force is applied with a locking clamp placed on top of the cover plate. In another embodiment, a hydraulic press is used to apply the compressive force. Once compression has begun, glue squeeze out is wiped away, and the assembly is allowed to cure for about five minutes. In an alternative embodiment, the assembly is allow to cure for between 2.5 and 7.5 minutes. In another embodiment, the assembly is allow to cure for up to one hour. Compression and curing occurs at room temperature, but in an alternative embodiment, occurs at an elevated temperatures between 70° F. and 100° F. (21.1° C. and 37.8° C.). By using a large compressive force applied on the external surface 313 of each subcomponent 301 while the puck 300 is otherwise immobilized, the keyed features 323 and interior surfaces 303 of subcomponents 301 are pressed against each other, and the adhesive forms a mechanical or chemical bond to seal subcomponents 301 together. In one embodiment, more than about 30 N of force is applied on the external surface of each subcomponent. In another embodiment, more than about 15 N of force is applied on the external surface of each subcomponent. In yet another embodiment, more than about 5 N of force is applied on the external surface of each subcomponent. After the assembly has cured, the compressive force and the cover plate are removed, and the assembled pucks are removed from the compression fixture. After removal from the fixture, the puck undergoes an inspection and testing 527. In one embodiment, inspection of the puck 300 includes, but is not limited to, verification that exterior indicator markings point in substantially the same direction, that there is no gap between the two subcomponents 301, the puck weight is about 6.588 ounces, or in an alternative embodiment the puck weight is between about 6.33 ounces and about 6.84 ounces, or in an alternative embodiment the puck weight is between about 3.0 ounces and about 16.0 ounces, and that the diodes 321 and other electronic components on the signal transmitter 110 are functional.

Figure 53:
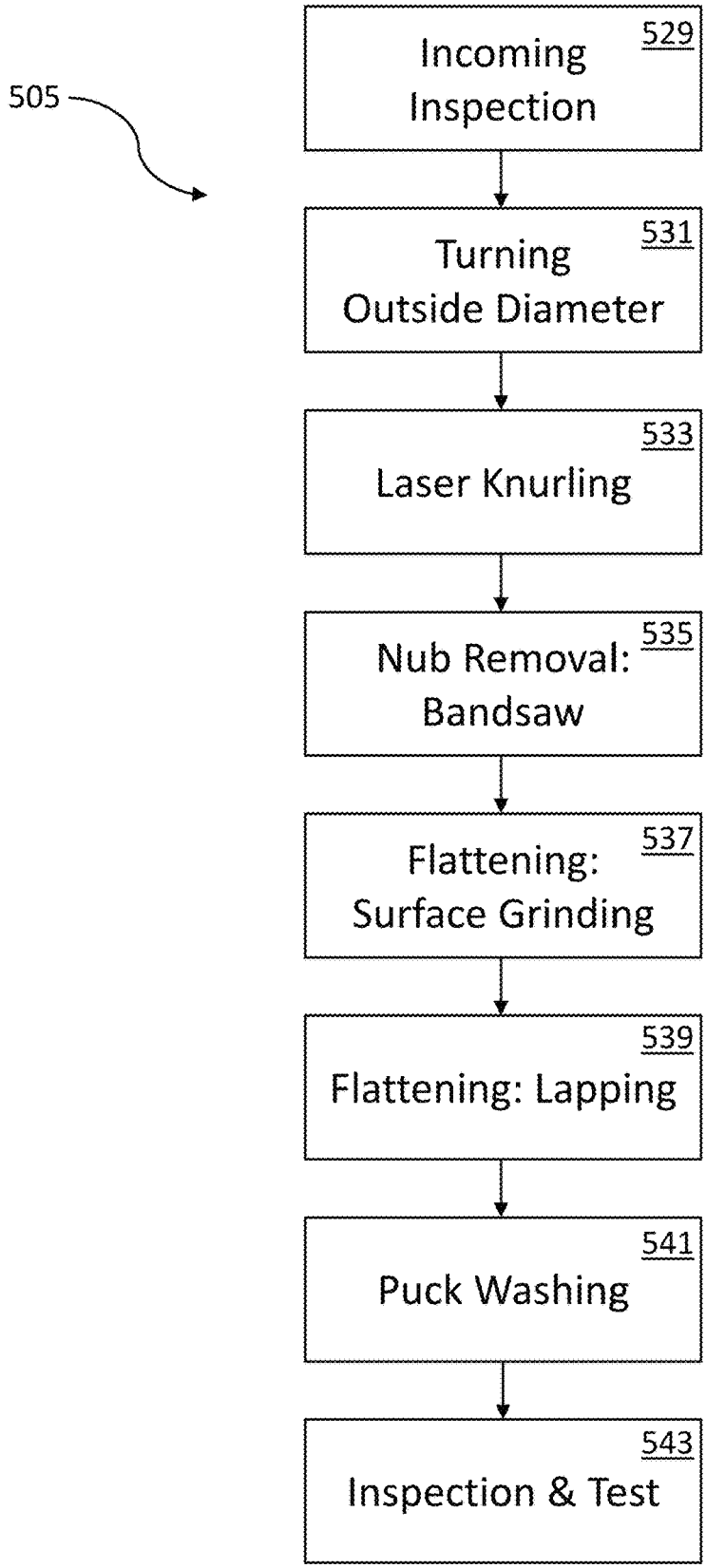
FIG. 53 illustrates a process for finishing an outside of a hockey puck for use, according to one embodiment of the present invention.

FIG. 53 illustrates the process for finishing the outside of a hockey puck for use according to one embodiment of the present invention. First, the assembled puck is inspected 529. Then, the outside diameter of the puck is turned 531, the puck undergoes laser knurling 533, nub removal 535, surface grinding 537, and lapping 539, and finally is washed 541 before a final inspection and test 543. In one embodiment, inspection of the assembled puck 529 includes, but is not limited to, verifying that there are no major scratches or imperfections that would be visible on the final product, tactile feel, that the puck 300 is the proper weight, and that the puck 300 is the proper thickness.

In turning the outside diameter of the puck 531, the vertical sides 343 are made smooth and remaining glue squeeze-out from assembly is removed. In one embodiment, remaining glue squeeze-out is removed by a scraper or other mechanical means. With at least two passes using a turning tool, about 0.100 inches is removed from the outside diameter of the puck 300. In an alternative embodiment, between about 0.01 and about 0.50 inches are removed from the outside diameter of the puck 300. In one embodiment, this occurs on a CNC lathe, and in an alternative embodiment, occurs on a manual lathe. In another embodiment, a laser is used. In one embodiment, the puck runs on the turning tool with less than about 0.002 run out. After the outside diameter is decreased and the vertical sides 343 has been completely turned, the vertical sides 343 are polished in order to remove tooling marks and improve the surface finish. During the polishing process, the puck 300 is kept wet. The vertical sides 343 or puck 300 are sanded at least one time with at least one sandpaper grit. In a preferred embodiment, the vertical sides 343 of puck 300 are sanded twice with 600 grit sandpaper and then twice with 1500 grit sandpaper such that the vertical sides 343 meet a surface finish standard level of at least B-3 according to Society of the Plastics Industry (SPI) standards. In a preferred embodiment, the outside diameter of the puck 300 after polishing is between about 2.995 inches and about 3.020 inches. In an alternative embodiment, the outside diameter of the puck 300 after polishing is between about 2.90 inches and about 3.10 inches. In yet another embodiment, the final outside diameter of the puck 300 after polishing is between about 2.50 inches and about 3.50 inches. After turning, knurling is created on the vertical sides 343 of the puck 300. In one embodiment, the knurling is created on the vertical sides 343 of the puck 300 using a laser. Knurling, which in one embodiment is in the form of a dimple pattern or a diamond knurl pattern, is common for a conventional hockey puck in order to increase friction between the puck 100 and a hockey stick for improved handling, passing, and shooting of the puck. In one embodiment, a Gantry carbon dioxide ($CO_2$) 80 Watt laser with a rotary attachment is used to provide the knurling. After laser knurling 533, there is no seam between the two subcomponents 301 that is visible with an unaided eye at 14 inches at standard office light levels, or, in another embodiment, at a distance of greater than 8 inches at standard office light levels.

Turning now to the external surfaces 313 of the puck 300, the first step is the removal of nubs from the puck 535. Nubs are initially present as the raised diode housings 317 that were molded with each subcomponent 301. The nubs are able to be removed from the puck 300 in a variety of ways, including by using a band saw, hand saw, sander, other mechanical means, or a laser. In a nonlimiting embodiment, the puck 300 is placed in a vice and the nubs are cut off of each side of the puck 300 with a band saw. Then, in order to provide the final surface texture of the puck, the external surfaces 313 are must be completely flattened. First, in surface grinding the puck 537 a grinder is used to ensure each external surface 313 is completely flat. In one embodiment, a hydraulic surface grinder is used to flatten each external surface 313. In an alternative embodiment, a different tool is used. Preferably, the surface grinder removes any residual material from the nubs. Preferably, the surface grinder also reduces the overall puck surface by about 0.010 inches on each side, thereby reducing the total height of the puck. In another embodiment, the surface grinder reduces the overall puck surface by between about 0.005 inches and about 0.1 inches.

After grinding, the puck 300 undergoes lapping and a final surface finishing. In lapping the puck 539, the surface is made smooth, and in a preferred embodiment reaches a surface finish standard level of at least B-1 according to Society of the Plastics Industry (SPI) standards with a waviness height of no more than about 0.004 inches, and in an alternative embodiment a waviness height of no more than about 0.01 inches. There are multiple processes available to achieve this level of finish, but in a preferred embodiment, the following process is used: 1) installing an 18 micrometer diamond disc on lapping machine and ensuring there is adequate coolant available, wherein the coolant is preferably a 6:1 mixture of VASCO 6000. 2) Loading pucks into the lapping machine. 3) Mounting the fixture and puck assembly onto the lapper lower puck. 4) Lapping for 2 minutes, 30 seconds with the disc set to 600 revolutions per minute and the gears for each puck set to 10 revolutions per minute. 5) Repeating for other side of pucks and then removing pucks from fixtures. 6) Installing a 6 micrometer diamond disc on lapping machine and ensuring there is adequate coolant available. 7) Loading pucks into the lapping machine. 8) Mounting the fixture and puck assembly onto the lapper lower puck. 9) Lapping for 5 minutes with the disc set to 600 revolutions per minute and the gears for each puck set to 10 revolutions per minute. 10) Repeating for other side of pucks and then removing pucks from fixtures. After lapping, the final thickness of the puck 300 is achieved. In a preferred embodiment, the thickness of the puck 300 after lapping is between about 0.980 inches and 1.005 inches, or in an alternative embodiment the thickness of the puck 300 after lapping is between about 0.95 inches and about 1.01 inches, or in yet another embodiment the thickness of the puck 300 after lapping is between about 0.75 inches and about 1.5 inches.

In washing the puck 541, the puck is not submerged in water. In one embodiment, washing the puck 541 occurs with dish soap and hot tap water, and the puck is not completely submerged in water. After washing of the puck, the puck undergoes final inspection and testing 543. In one embodiment, inspection and testing of the puck includes, but is not limited to, tactile feel, surface cleanliness, surface finish, verification that final outside diameter is between about 2.995 inches and about 3.020 inches, or in an alternative embodiment is between about 2.95 inches and about 3.05 inches, or in yet another embodiment is between about 2.5 inches and about 3.5 inches, verifying that the thickness of the puck is between about 0.980 inches and 1.005 inches, or in an alternative embodiment is between about 0.95 inches and about 1.01 inches, or in yet another embodiment is between about 0.75 inches and about 1.5 inches, verifying that the weight of the puck is between about 5.5 and about 6.0 ounces, or in an alternative embodiment is between about 5.0 ounces and 7.0 ounces, or in an alternative embodiment is between about 3.0 ounces and 16.0 ounces, and ensuring functionality of all electronic components.

In summary, embodiments of the present technology relate to a hockey puck, comprising: first and second subcomponents including complementary features operable to mate with each other, the first and second subcomponents together defining a central void interior to the first and second subcomponents together; a capsule sized and shaped to fit within the central void of the first and second subcomponents, the capsule including a central space interior to the capsule; and a signal transmitter sized and shaped to fit within the central space of the capsule, the signal transmitter operable to emit electromagnetic radiation to enable detection of an instantaneous position of the hockey puck.

In further embodiments, the present technology relates to a hockey puck, comprising: first and second subcomponents including complementary features operable to mate with each other, the first and second subcomponents together defining a central void interior to the first and second subcomponents together; and a signal transmitter sized and shaped to fit within the central void of the first and second subcomponents, the signal transmitter operable to emit electromagnetic radiation to enable detection of an instantaneous position of the hockey puck; wherein the first and second subcomponents comprise a first set of materials, the first set of materials absorbing a greater amount of energy than a second set of materials used in a second hockey puck having a solid core without the signal transmitter.

In other embodiments, the present technology relates to a hockey puck, comprising: first and second subcomponents including complementary features operable to mate with each other, the first and second subcomponents together defining a central void interior to the first and second subcomponents together; and a signal transmitter sized and shaped to fit within the central void of the first and second subcomponents, the signal transmitter operable to emit electromagnetic radiation in a wavelength band to enable detection of an instantaneous position of the hockey puck; wherein the first and second subcomponents comprise materials that are transparent to the wavelength band at which the electromagnetic radiation is emitted.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It is intended that the scope of the invention be defined by the claims appended hereto.

The invention claimed is:

1. A hockey puck, comprising:

a first subcomponent attached to a second subcomponent; and a signal transmitter operable to generate and emit electromagnetic radiation, wherein the signal transmitter includes at least one power source and at least one diode;

wherein the electromagnetic radiation from the signal transmitter is configured to be received by a plurality of external sensors;

wherein the first subcomponent has a first interior surface with a first set of ridges and valleys, wherein the second subcomponent has a second interior surface with a second set of ridges and valleys, and wherein the first set of ridges and valleys and the second set of ridges and valleys are arranged concentrically on the first interior surface and the second interior surface, respectively;

wherein the valleys of the first set of ridges and valleys are constructed to receive the ridges of the second set of ridges and valleys;

wherein the valleys of the second set of ridges and valleys are constructed to receive the ridges of the first set of ridges and valleys;

wherein the first interior surface and the second interior surface form an interior void;

wherein the signal transmitter is enclosed by a capsule;

wherein the capsule is comprised of two identical sub-capsule halves;

wherein the two identical sub-capsule halves include a plurality of axially extending light pipes;

wherein the capsule is sized to fit within the interior void;

wherein the first interior surface includes at least one first curved notch extending from a first outer radius of the first interior surface to a first inner portion of the first subcomponent, and the second interior surface includes at least one second curved notch extending from a second outer radius of the second interior surface to a second inner portion of the second subcomponent;

wherein, when the first subcomponent and the second subcomponent are combined, the at least one first curved notch and the at least one second curved notch define channels for at least one light pipe extending from an outer radius of the puck to the interior void of the puck;

wherein a first set of openings for the plurality of axially extending light pipes positioned orthogonal to the first subcomponent integrally formed through a thickness of the first subcomponent and a second set of openings for the plurality of axially extending light pipes positioned orthogonal to the second subcomponent integrally formed through a thickness of the second subcomponent; and wherein the puck is operable to provide an identification of a location of the puck on an ice rink via the electromagnetic radiation received by the plurality of external sensors.

2. The hockey puck of claim 1, wherein the first set of ridges and valleys and the second set of ridges and valleys each include concentric rows of alternating ridges and valleys around a center of the puck.

3. The hockey puck of claim 1, wherein the first interior surface and the second interior surface further include indentations sized to receive at least one sensor and at least one antenna of the signal transmitter.

4. The hockey puck of claim 1, wherein the at least one light pipe is sized to receive the at least one diode of the signal transmitter.

5. The hockey puck of claim 1, wherein the first set of ridges and valleys and the second set of ridges and valleys are sandblasted and/or chemically etched.

6. A hockey puck, comprising:

a first subcomponent attached to a second subcomponent; and a signal transmitter operable to generate and emit electromagnetic radiation, wherein the signal transmitter includes at least one power source and at least one diode;

wherein the electromagnetic radiation from the signal transmitter is configured to be received by a plurality of external sensors;

wherein the first subcomponent has a first interior surface and the second subcomponent has a second interior surface, and wherein the first interior surface includes a first set of concentrically arranged wedges and the second interior surface has a second set of concentrically arranged wedges;

wherein the first set of concentrically arranged wedges and the second set of concentrically arranged wedges each include concentric rows of alternating peaks and valleys around a center of the puck;

wherein peaks of the first set of concentrically arranged wedges are constructed to fit into valleys of the second set of concentrically arranged wedges of the second interior surface;

wherein the first interior surface and the second interior surface form an interior void;

wherein the signal transmitter is enclosed by a capsule;

wherein the capsule is comprised of two identical sub-capsule halves;

wherein the two identical sub-capsule halves include a plurality of axially extending light pipes;

wherein the capsule is sized to fit within the interior void;

wherein the first interior surface includes at least one first curved notch extending from a first outer radius of the first interior surface to a first inner portion of the first subcomponent, and the second interior surface includes at least one second curved notch extending from a second outer radius of the second interior surface to a second inner portion of the second subcomponent;

wherein, when the first subcomponent and the second subcomponent are combined, the at least one first curved notch and the at least one second curved notch define channels for at least one light pipe extending from an outer radius of the puck to the interior void of the puck;

wherein a first set of openings for the plurality of axially extending light pipes positioned orthogonal to the first subcomponent integrally formed through a thickness of the first subcomponent and a second set of openings for the plurality of axially extending light pipes positioned orthogonal to the second subcomponent integrally formed through a thickness of the second subcomponent; and wherein the puck is operable to provide an identification of a location of the puck on an ice rink via the electromagnetic radiation received by the plurality of external sensors.

7. The hockey puck of claim 6, wherein the one or more light pipes extend from the first interior surface of the first subcomponent to an exterior surface of the first subcomponent or from the second interior surface of the second subcomponent to an exterior surface of the second subcomponent.

8. The hockey puck of claim 6, wherein the interior void is sized to securely contain the signal transmitter and at least one power source.

9. The hockey puck of claim 6, wherein the signal transmitter is enclosed in a capsule in the interior void.

10. The hockey puck of claim 6, wherein the first subcomponent and the second subcomponent are attached with an adhesive material applied to the first set of concentrically arranged wedges and the second set of concentrically arranged wedges.

11. The hockey puck of claim 6, wherein the concentric rows of alternating peaks and valleys are divided into at least two subsets, wherein the alternating peaks of a first of the at least two subsets are constructed with an inverted pattern of the alternating peaks and valleys a second of the at least two subsets.

* * * * *